US008384627B2

(12) United States Patent
Yamashita et al.

(10) Patent No.: US 8,384,627 B2
(45) Date of Patent: Feb. 26, 2013

(54) DISPLAY DEVICE AND ELECTRONIC EQUIPMENT

(75) Inventors: Junichi Yamashita, Tokyo (JP); Katsuhide Uchino, Kanagawa (JP)

(73) Assignee: Sony Corporation, Tokyo (JP)

( * ) Notice: Subject to any disclaimer, the term of this patent is extended or adjusted under 35 U.S.C. 154(b) by 9 days.

(21) Appl. No.: 13/428,526

(22) Filed: Mar. 23, 2012

(65) Prior Publication Data

US 2012/0176360 A1 Jul. 12, 2012

Related U.S. Application Data

(63) Continuation of application No. 12/314,649, filed on Dec. 15, 2008, now Pat. No. 8,169,384.

(30) Foreign Application Priority Data

Jan. 15, 2008 (JP) ..... 2008-005256

(51) Int. Cl.
*G09G 3/30* (2006.01)

(52) U.S. Cl. ..... 345/76; 345/204; 315/169.3

(58) Field of Classification Search ..... 345/76–83, 345/204–215; 315/169.3
See application file for complete search history.

(56) References Cited

U.S. PATENT DOCUMENTS

| | | | |
|---|---|---|---|
| 7,057,588 | B2 | 6/2006 | Asano et al. |
| 7,102,202 | B2 | 9/2006 | Kobayashi et al. |
| 7,109,952 | B2 | 9/2006 | Kwon |
| 2005/0206590 | A1 | 9/2005 | Sasaki et al. |
| 2005/0269959 | A1 | 12/2005 | Uchino et al. |
| 2006/0176250 | A1 | 8/2006 | Nathan et al. |
| 2007/0268210 | A1 | 11/2007 | Uchino et al. |

FOREIGN PATENT DOCUMENTS

| | | | |
|---|---|---|---|
| JP | 2003-255856 | A | 9/2003 |
| JP | 2003-271095 | A | 9/2003 |
| JP | 2004-029791 | A | 1/2004 |
| JP | 2004-093682 | A | 3/2004 |
| JP | 2004-133240 | A | 4/2004 |
| JP | 2007-310311 | A | 11/2007 |

OTHER PUBLICATIONS

Japanese Office Action issued Dec. 22, 2009 for corresponding Japanese Application No. 2008-005256.

*Primary Examiner* — Hong Zhou
(74) *Attorney, Agent, or Firm* — Rader Fishman & Grauer, PLLC

(57) ABSTRACT

A display device includes: a pixel array section; and a drive section, the pixel array section including scan lines, signal lines, pixels, and power lines, the drive section including a main scanner, a drive scanner, and a signal selector, wherein each of the pixels includes a light-emitting element, sampling transistor, drive transistor, and holding capacitor.

2 Claims, 17 Drawing Sheets

(T2-T4)

(T4-T5)

(T6-T7)

(T8 ~)

DISPLAY DEVICE AND ELECTRONIC EQUIPMENT

CROSS REFERENCES TO RELATED APPLICATIONS

This is a Continuation Application of U.S. patent application Ser. No. 12/314,649, filed Dec. 15, 2008, which claims priority from Japanese Patent Application JP 2008-005256 filed in the Japan Patent Office on Jan. 15, 2008, the entire contents of which being incorporated herein by reference.

BACKGROUND OF THE INVENTION

1. Field of the Invention

The present invention relates to an active matrix display device using a light-emitting element in each of its pixels. The present invention also relates to electronic equipment having a display device of this type.

2. Description of the Related Art

Recent years have seen a brisk development of self-luminous flat display devices using organic Electro Luminescence (EL) elements. An organic EL element relies on light emission from an organic thin film when applied with an electric field. This element is low in power consumption thanks to a small applied voltage of 10V or less. Further, this element is self-luminous and emits light, eliminating the need for illuminating members and permitting easy reduction of the weight and thickness. Further, this element offers extremely high response speed or approximately several μs, thus producing no afterimage during display of a moving image.

Among other self-luminous flat display devices using organic EL elements, the development of active matrix display devices having a thin film transistor integrated in each pixel as a driving element is going on at a brisk pace. An active matrix self-luminous flat display device is disclosed in Patent Documents, for example, Japanese Patent Laid-Open No. 2003-255856, Japanese Patent Laid-Open No. 2003-271095, Japanese Patent Laid-Open No. 2004-133240, Japanese Patent Laid-Open No. 2004-029791, and Japanese Patent Laid-Open No. 2004-093682.

SUMMARY OF THE INVENTION

However, existing self-luminous flat display devices undergo a variation in threshold voltage and mobility of the transistor adapted to drive the light-emitting element due to process change. Further, the organic EL element experiences a change in its characteristics over time. Such a variation in the drive transistor characteristics and change in the characteristics of the organic EL element will affect the light emission brightness. To ensure uniform light emission brightness across the screen of the display device, the characteristic changes of the transistor and organic EL element must be corrected in each pixel circuit. Display devices have been heretofore proposed in which each pixel has correction functions for such characteristics. However, existing pixel circuits having correction functions require not only wirings adapted to supply a correction potential but also a switching transistor and switching control pulse, resulting in a complicated configuration of the pixel circuit. The need for a large number of components in the pixel circuit has been a detriment to achieving higher definition of the display device.

In view of the foregoing problem with the existing art, it is an desirable to provide a display device capable of providing higher definition of the display by simplifying the pixel circuit. In order to achieve the above desire, the present embodiment provides the following means. That is, the display device according to the present embodiment includes a pixel array section and a drive section adapted to drive the pixel array section. The pixel array section includes scan lines, signal lines, pixels and power lines. The scan lines are arranged in rows. The signal lines are arranged in columns. The pixels are arranged in a matrix form. Each of the pixels is disposed at the intersection between one of the scan lines and one of the signal lines. The power lines are each disposed for one of the pixel rows. The drive section includes a main scanner, drive scanner and signal selector. The main scanner supplies a sequential control signal to each of the scan lines to perform a linear sequential scan of the pixels on a row by row basis. The drive scanner supplies a supply voltage to each of the power lines in step with the linear sequential scan. The supply voltage switches between first and second potentials. The signal selector supplies two potentials, a signal potential serving as a video signal and a reference potential, to the signal lines arranged in columns in step with the linear sequential scan. Each of the pixels includes a light-emitting element, sampling transistor, drive transistor and holding capacitor. The sampling transistor has its gate connected to the scan line, one of its source and drain connected to the signal line and the other of its source and drain connected to the gate of the drive transistor. The drive transistor is a P-channel transistor. The same transistor has its source connected to the cathode of the light-emitting element and its drain connected to the ground wiring. The holding capacitor is connected between the source and gate of the drive transistor. The light-emitting element has its anode connected to the power line and its cathode connected to the source of the drive transistor. The display device is as follows. That is, during a period of time in which the signal selector supplies the reference potential to the signal line, the main scanner supplies the control signal to the scan line, bringing the sampling transistor into conduction. On the other hand, the drive scanner changes the power line between the first and second potentials, thus holding a voltage corresponding to the threshold voltage of the drive transistor in the holding capacitor. During a period of time in which the signal selector supplies the signal potential to the signal line, the main scanner supplies the control signal to the scan line, bringing the sampling transistor into conduction. This causes the signal potential from the signal line to be sampled and held in the holding capacitor. During a period of time in which the drive scanner maintains the power line at the first potential, the drive transistor passes a drive current, commensurate with the held signal potential, through the light-emitting element.

When the sampling transistor samples the signal potential from the signal line and holds the potential in the holding capacitor, the drive current flowing through the drive transistor should preferably be fed back to the holding capacitor to correct the signal potential so as to correct the drive transistor mobility. The sampling transistor is also a P-channel transistor. The main scanner removes the control signal from the scan line when the signal potential is held in the holding capacitor, bringing the sampling transistor out of conduction and electrically disconnecting the gate of the drive transistor from the signal line. This causes the gate potential of the drive transistor to change with change in the source potential thereof (bootstrapping action), thus maintaining the gate-to-source potential constant.

The display device according to the present embodiment has threshold voltage correction, mobility correction, bootstrapping and other functions in each of the pixels. The threshold voltage correction function permits correction of the variation in the threshold voltage of the drive transistor.

Similarly, the mobility correction function permits correction of the variation in the mobility of the drive transistor. Further, the bootstrapping action of the holding capacitor maintains the light emission brightness constant at all times during light emission, irrespective of the changes in the characteristics of the organic EL element. That is, the gate-to-source voltage of the drive transistor remains constant by the bootstrapping action despite the change in the current-voltage characteristic of the drive transistor over time, thus maintaining the light emission brightness constant.

According to the present embodiment, each of the pixels only includes a light-emitting element, sampling transistor, drive transistor and holding capacitor to provide the threshold voltage correction, mobility correction, bootstrapping and other functions. This has reduced the number of transistor elements to two, which is fewer than in the existing art. The pixel configuration simplified as described above provides the above correction functions. The simplification of the pixel circuit permits reduction of the pixel size, thus allowing to achieve higher definition of the display device.

In order to simplify the pixel circuit in particular, the drive transistor is a P-channel transistor with the source thereof connected to the cathode of the light-emitting element. A P-channel transistor has a smaller variation in the threshold voltage and mobility than an N-channel transistor, making it easier to correct the threshold voltage and mobility thereof. Further, the Early effect is less conspicuous in a P-channel transistor than in an N-channel transistor, making the drive current supplied by the drive transistor less susceptible to the impact of change in supply voltage. As described above, a P-channel transistor for use as the drive transistor minimizes the variation in brightness attributable to a number of factors, thus providing improved screen uniformity.

To incorporate the threshold voltage correction, mobility correction, bootstrapping and other functions in the present embodiment, the supply voltage supplied to each of the pixels serves as a switching pulse. Using the supply voltage as a switching pulse eliminates the need for a switching transistor adapted to correct the threshold voltage and a scan line adapted to control the gate of the switching transistor. This ensures significant reduction of pixel circuit components and wirings, thus permitting reduction of the pixel area and achieving higher definition of the display device. Further, the mobility correction is performed simultaneously with the sampling of the video signal potential, thus similarly permitting simplification of the pixel circuit configuration and wirings and contributing to reduced pixel size.

DETAILED DESCRIPTION OF THE PREFERRED EMBODIMENTS

Figure 1:
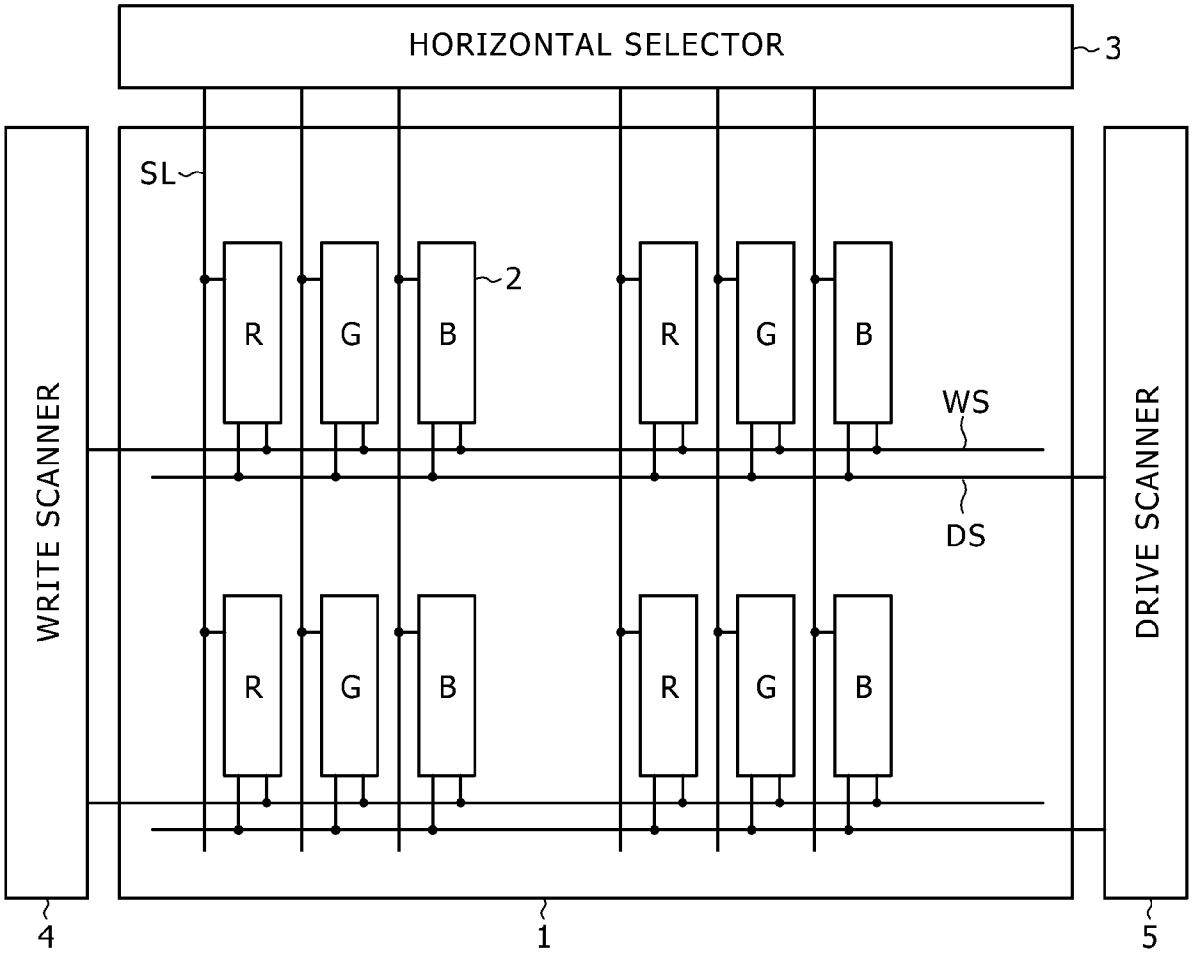
FIG. 1 is a block diagram illustrating the overall configuration of a display device according to the present embodiment.

The preferred embodiments of the present invention will be described below with reference to the accompanying drawings. FIG. 1 is a block diagram illustrating the overall configuration of a display device according to the present embodiment. As illustrated in FIG. 1, the present display device includes a pixel array section 1 and a drive section adapted to drive the pixel array section 1. The pixel array section 1 includes scan lines WS arranged in rows, power lines DS similarly arranged in rows, signal lines SL arranged in columns and pixels 2 arranged in a matrix form. Each of the pixels 2 is disposed at the intersection between one of the scan lines WS and one of the signal lines SL. It should be noted that, in the present example, each of the pixels 2 is assigned one of the three primary colors or R, G and B to display a color image. However, the present invention is not limited to such a configuration and includes monochrome display panels. The drive section includes a write scanner (main scanner) 4, drive scanner 5 and horizontal selector (signal selector) 3. The write scanner 4 supplies a sequential control signal to each of the scan lines WS to perform a linear sequential scan of the pixels 2 on a row by row basis. The drive scanner 5 supplies a supply voltage to the power lines DS in step with the linear sequential scan so as to cause the pixels 2 to perform a predetermined correction operation. The supply voltage switches between high and low potentials Vcc and Vss. The horizontal selector 3 supplies two potentials, a signal potential Vsig serving as a video signal and a reference potential Vofs, to the signal lines SL arranged in columns in step with the linear sequential scan.

Figure 2:
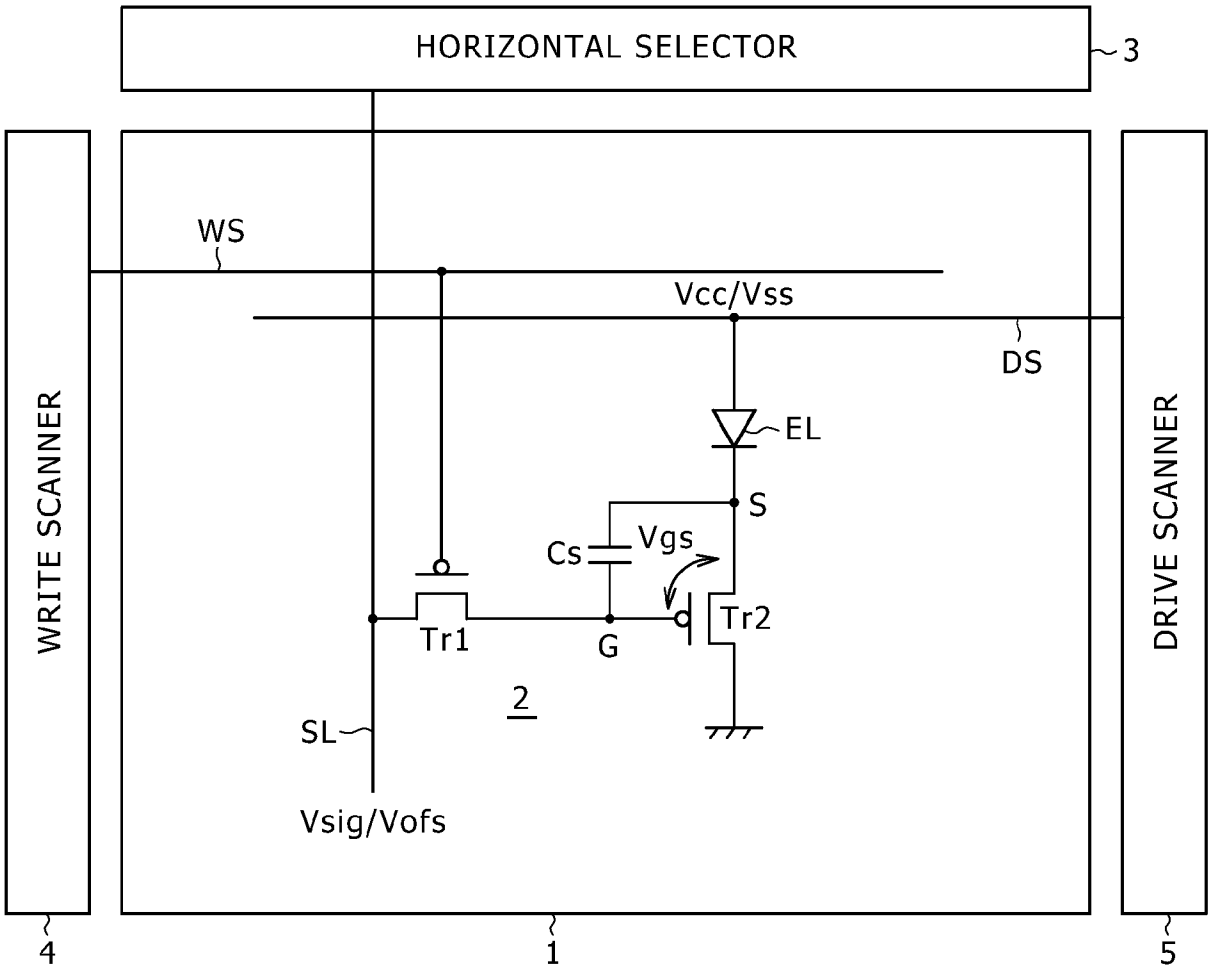
FIG. 2 is a circuit diagram illustrating an embodiment of the display device shown in FIG. 1.

FIG. 2 is a circuit diagram illustrating a concrete configuration of the pixel 2 in the display device shown in FIG. 1. As illustrated in FIG. 2, the pixel 2 includes a light-emitting element EL, sampling transistor Tr1, drive transistor Tr2 and holding capacitor Cs. Including only two transistors, the pixel circuit 2 is considerably simpler than the existing art, thus allowing to achieve higher definition of the pixel array section.

The sampling transistor Tr1 is a P-channel transistor and has its gate connected to the scan line WS, one of its source and drain connected to the signal line SL and the other of its source and drain connected to a gate G of the drive transistor Tr2. The drive transistor Tr2 is a P-channel transistor and has a source S connected to the cathode of the light-emitting element EL and its drain connected to the ground wiring. The holding capacitor Cs is connected between the source S and gate G of the drive transistor Tr2. The light-emitting element EL is a two-terminal element such as organic EL element. The same element EL has its anode connected to the power line DS and its cathode connected to the source S of the drive transistor Tr2 as mentioned earlier.

It should be noted that the present embodiment uses a P-channel transistor as the sampling transistor Tr1. However, the present embodiment is not limited thereto, but the same transistor Tr1 may be an N-channel transistor. One of the features of the present embodiment is that a P-channel transistor is used as the drive transistor.

During a period of time in which the signal selector (horizontal selector) 3 supplies the reference potential Vofs to the signal line SL, the main scanner (write scanner) 4 supplies the control signal to the scan line WS, bringing the sampling transistor Tr1 into conduction. On the other hand, the drive scanner 5 changes the power line DS between the first potential (high potential Vcc) and second potential (low potential Vss), holding a voltage corresponding to the threshold voltage Vth of the drive transistor Tr2 in the holding capacitor Cs. Next, during a period of time in which the signal selector (horizontal selector) 3 supplies the signal potential Vsig to the signal line SL, the main scanner (write scanner) 4 supplies the control signal to the scan line WS, bringing the sampling transistor Tr1 into conduction again. This causes the signal potential Vsig from the signal line SL to be sampled and held in the holding capacitor Cs. Then, during a period of time in which the drive scanner 5 maintains the power line DS at the first potential (high potential) Vcc, the drive transistor Tr2 passes a drive current, commensurate with the signal potential Vsig held in the holding capacitor Cs, through the light-emitting element EL. At this time, the potential held in the holding capacitor Cs is applied between the source S and gate G of the P-channel drive transistor Tr2 as the gate voltage Vgs. The voltage corresponding to the threshold voltage Vth of the drive transistor Tr2 is written to the holding capacitor Cs in advance before the signal potential Vsig is written to the same capacitor Cs. This ensures that the impact of the threshold voltage Vth of the drive transistor Tr2 is cancelled out. As a result, the brightness of the light-emitting element remains unaffected even in the event of a variation of the threshold voltage Vth of the drive transistor Tr2 between different pixels.

The drive transistor Tr2 operates in the saturation region and passes a drain current Ids, commensurate with the gate voltage Vgs held in the holding capacitor Cs, through the light-emitting element EL. At this time, the P-channel drive transistor Tr2 is less affected by the Early effect than an N-channel transistor. In other words, the drain current Ids is less susceptible to the variation of the drain voltage. This allows for the P-channel drive transistor to pass the drain current Ids, determined by Vgs, through the light-emitting element EL without being significantly affected by the variation of the supply voltage, thus providing less likelihood of uneven brightness.

When the sampling transistor Tr1 samples the signal potential Vsig from the signal line SL and holds the potential in the holding capacitor Cs, the drive current flowing through the drive transistor Tr2 is fed back to the holding capacitor Cs to correct the signal potential Vsig so as to correct a mobility μ of the drive transistor Tr2. Such a configuration allows for the pixel circuit to correct not only the threshold voltage Vth but also the mobility μ of the drive transistor Tr2 with a small number of transistor elements.

Further, the main scanner (write scanner) 4 removes the control signal from the scan line WS after the signal potential Vsig is written to the holding capacitor Cs, bringing the sampling transistor Tr1 out of conduction and electrically disconnecting the gate G of the drive transistor Tr2 from the signal line SL. This causes the gate potential of the drive transistor Tr2 to change with change in the source potential thereof, thus maintaining the potential Vgs between the gate G and source S constant. Such a bootstrapping action maintains Vgs constant irrespective of the change in the current-voltage characteristic of the light-emitting element EL.

Figure 3:
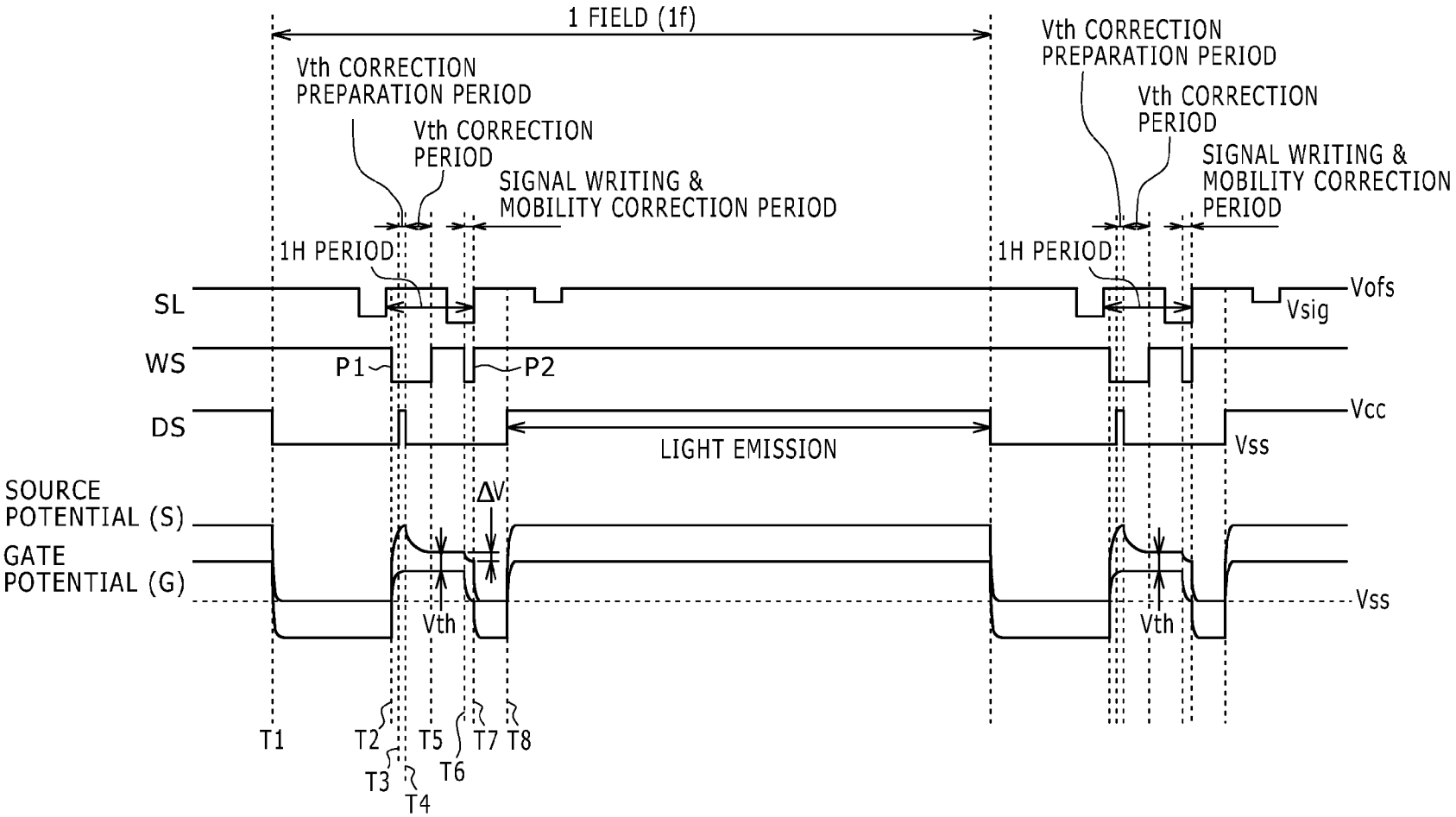
FIG. 3 is a timing diagram used to describe the operation of the display device shown in FIG. 2.

FIG. 3 is a timing diagram used to describe the operation of the pixel circuit 2 shown in FIG. 2. This timing diagram illustrates the waveforms of the control signal applied to the scan line WS and the supply voltage applied to the power line DS along a time axis T. The sampling transistor Tr1 is a P-channel transistor. Therefore, the same transistor Tr1 is on when the scan line WS is at low level and off when the same line WS is at high level. This timing diagram illustrates the changes in potential of the gate G and source S of the drive transistor Tr2 together with the waveform of the control signal WS. The diagram also illustrates the waveform of the video signal applied to the signal line SL. The video signal alternates between the signal potential Vsig and reference potential Vofs within one horizontal period (1H period).

A control signal pulse is applied to the scan line WS to turn on the sampling transistor Tr1. This control signal pulse is applied to the scan line WS over a period of one field in step with the linear sequential scan of the pixel array section. The same pulse contains two pulses during one horizontal scan period (1H). The first pulse is referred to as a first pulse P1, and the second pulse as a second pulse P2. The power line DS similarly switches between the high and low potentials Vcc and Vss over a period of one field.

As illustrated in the timing diagram, the light emission period ends for the previous field, followed first by the non-light emission period for the current field and next by the light emission period for the same field. During the non-light emission period, preparation, threshold voltage correction, signal writing, mobility correction and other operations are performed.

During the light emission period for the previous field, the power line DS is at the high potential Vcc. As a result, the drive transistor Tr2 supplies the drive current (drain current Ids) to the light-emitting element EL. The drive current Ids flows from the power line DS at the high potential Vcc to the ground wiring via the light-emitting element EL and drive transistor Tr2.

Next, at time T1 when the non-light emission period begins for the current field, the power line DS changes from the high potential Vcc to the low potential Vss. This causes the power line DS to discharge to Vss. Further, the source S of the drive transistor Tr2 declines in potential to Vss. As a result, the anode-to-cathode voltage of the light-emitting element EL is nearly zero volt, bringing the same element EL into cutoff. Because there is no drive current, the light-emitting element EL goes out. At this time, the gate G of the drive transistor Tr2 declines in potential with the decline of the source S thereof.

Next, at time T2, the scan line changes from high to low level, bringing the sampling transistor Tr1 into conduction. In other words, the first control signal pulse P1 is applied to the scan line WS, turning on the sampling transistor Tr1. At this time, the signal line SL is at the reference potential Vofs. As a result, the potential of the gate G of the drive transistor Tr2 is brought to the level of the reference potential Vofs of the signal line SL via the sampling transistor Tr1.

At time t3 immediately thereafter, the power line DS changes from the low potential Vss to the high potential Vcc. This brings the source potential of the drive transistor. Tr2 close to Vcc. This operation sets the potential difference Vgs between the gate G and source S of the drive transistor Tr2 sufficiently greater than Vth, thus preparing the same transistor Tr2 for the Vth correction.

At time T4 thereafter, the power line DS changes from the high potential Vcc to the low potential Vss, initiating the discharge of the holding capacitor Cs connected between the source S and gate G of the drive transistor Tr2. This discharge causes the source potential of the drive transistor Tr2 to decline gradually. The current cuts off after a while when the voltage Vgs between the gate G and source S of the drive transistor Tr2 is brought equal to the threshold voltage Vth. Thus, the drive transistor voltage corresponding to the threshold voltage Vth is written to the holding capacitor Cs. This is the threshold voltage correction operation.

At time T5, the scan line WS changes from low to high level. In other words, the first pulse P1 is removed from the scan line WS, turning off the sampling transistor. As is clear from the above description, the first pulse P1 is applied to the gate of the sampling transistor Tr1 to perform the threshold voltage correction operation.

Thereafter, the signal line SL changes from the reference potential Vofs to the signal potential Vsig. Next, at time T6, the scan line WS changes from high to low level again. In other words, the second pulse P2 is applied to the gate of the sampling transistor Tr1. This turns on the sampling transistor Tr1 again, causing the same transistor Tr1 to sample the signal potential Vsig from the signal line SL. As a result, the potential of the gate G of the drive transistor Tr2 is brought equal to the signal potential Vsig. At this time, the drive transistor Tr2 turns on, causing the holding capacitor Cs to discharge. As a result, the source potential of the drive transistor Tr2 declines by ΔV. This decrement ΔV is proportional to the mobility μ of the drive transistor Tr2. The larger the mobility μ, the larger the decrement ΔV. This eventually corrects the impact of the variation of the mobility μ. Thus, the video signal potential Vsig is written to the holding capacitor Cs in such a manner that the same potential Vsig is added to Vth. Then, the mobility correction voltage ΔV is subtracted from the voltage held in the holding capacitor Cs.

As described above, the mobility correction operation is performed until time T7 when the scan line WS changes back to high level. Therefore, the period T6 to T7 from time T6 to T7 is the signal writing and mobility correction period. In other words, the application of the second pulse P2 to the scan line WS initiates the signal writing and mobility correction operation. The signal writing and mobility correction period T6 to T7 is equal in length to the width of the second pulse P2. That is, the width of the second pulse P2 determines the length of the mobility correction period.

Thus, the writing of the signal potential Vsig and the adjustment of the correction amount ΔV are performed simultaneously during the signal writing period T6 to T7. The lower Vsig, the larger the current Ids flowing through the drive transistor Tr2, and the larger the absolute value of ΔV. As a result, the mobility is corrected according to the light emission brightness level. Assuming the constant Vsig, the larger the mobility μ of the drive transistor Tr2, the larger the absolute value of ΔV. In other words, the larger the mobility μ, the larger the amount of feedback (i.e., discharged voltage or voltage drop) ΔV to the holding capacitor Cs. This eliminates the variation of the mobility μ between different pixels.

Finally at time T8, the power line DS changes from the low potential Vss to the high potential Vcc, causing the drain current Ids to start flowing through the light-emitting element EL. The cathode potential of the light-emitting element EL increases roughly to the level of Vcc. The increase in the cathode potential of the light-emitting element EL is none other than the increase in the potential of the source S of the drive transistor Tr2. As the potential of the source S of the drive transistor Tr2 increases, the potential of the gate G thereof will also increase because of the bootstrapping action. The increment of the gate potential will be equal to that of the source potential. Hence, the voltage Vgs between the gate G and source S of the drive transistor Tr2 is maintained constant during the light emission period. The Vgs value is equal to the signal potential Vsig corrected for the threshold voltage Vth and mobility μ. The drive transistor Tr2 operates in the saturation region. That is, the same transistor Tr2 supplies the drive current Ids commensurate with the voltage Vgs between the gate G and source S. The Vgs value is equal to the signal potential Vsig corrected for the correction of the threshold voltage Vth and mobility μ. The present embodiment is characterized in that the drive transistor Tr2 is a P-channel transistor. The Early effect is more suppressed in a P-channel transistor than in an N-channel transistor. As a result, the drain current Ids is less dependent upon the drain voltage, making the same current Ids less likely to be affected by the supply voltage.

Figure 4:
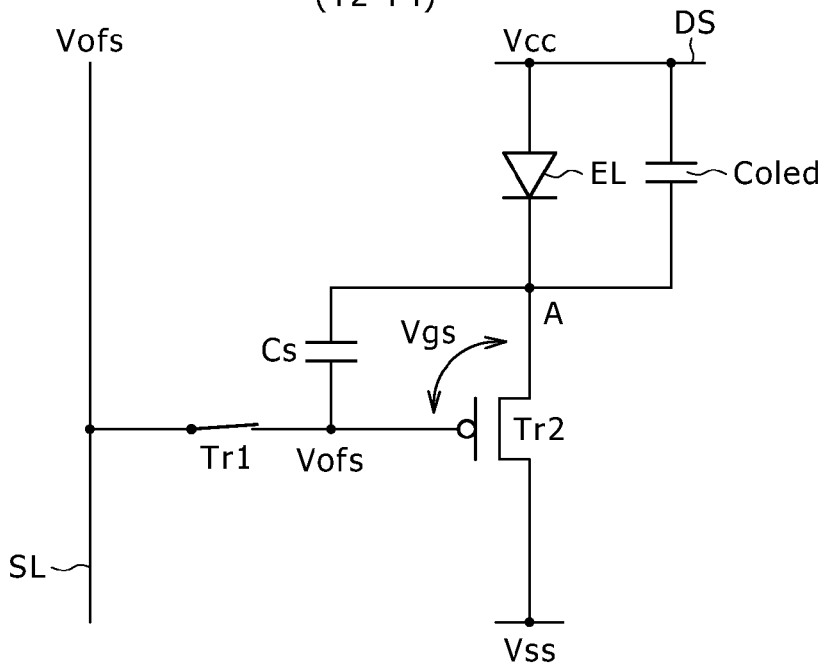
FIG. 4 is a diagrammatic sketch similarly used to describe the operation thereof.

A detailed description will be given next of the operation of the display device illustrated in FIGS. 1 and 2 with reference to FIGS. 4 to 7. FIG. 4 is a diagrammatic sketch illustrating the operating status of the pixel circuit during a Vth correction preparation period T2 to T4. During this preparation period, the control signal WS is pulled down to low level first to turn on the sampling transistor Tr1, thus causing the reference potential Vofs to be written to the gate G of the drive transistor Tr2. Next, the power line DS is pulled up to the high potential Vcc. This operation sets the voltage Vgs of the drive transistor Tr2 greater than the threshold voltage Vth thereof. To accomplish this, the condition Vcc−Vofs>|Vth| must be satisfied. Here, the source of the drive transistor Tr2 is assumed to be a node A. At this time, the drive transistor Tr2 is on. As a result, a current flows through the drive transistor Tr2. Therefore, the preparation period T2 to T4 should preferably be set as short as possible or several μs or less, and the Vofs value slightly larger than Vth.

Figure 5:
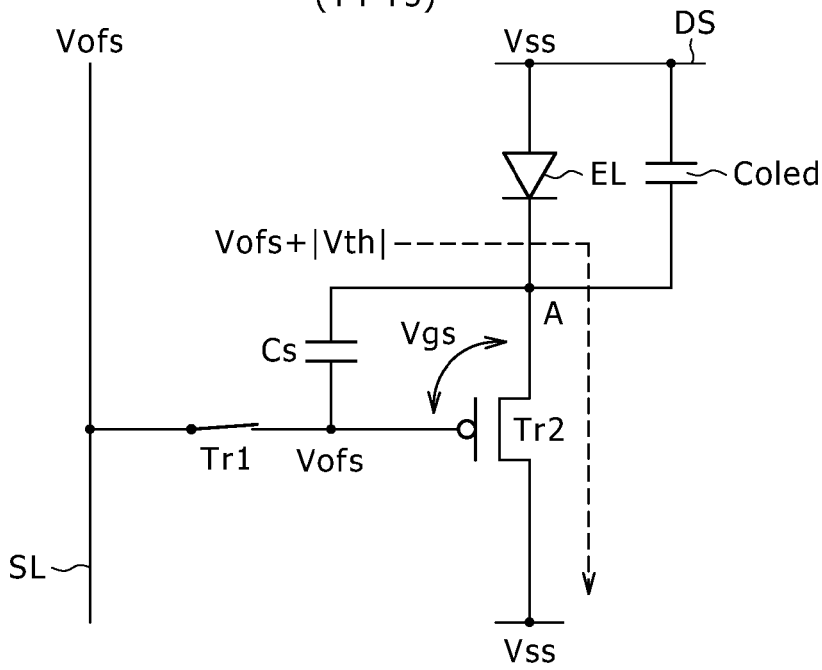
FIG. 5 is a diagrammatic sketch similarly used to describe the operation thereof.

FIG. 5 illustrates the operating status of the pixel circuit during a threshold voltage correction period T4 to T5. Here, the power line DS changes to the low potential Vss to bring the light-emitting element EL into cutoff. As a result, the source potential begins to discharge via the drive transistor Tr2. This brings the potential of the node A equal to Vofs+|Vth|, thus correcting the threshold voltage Vth of the drive transistor Tr2.

Figure 6:
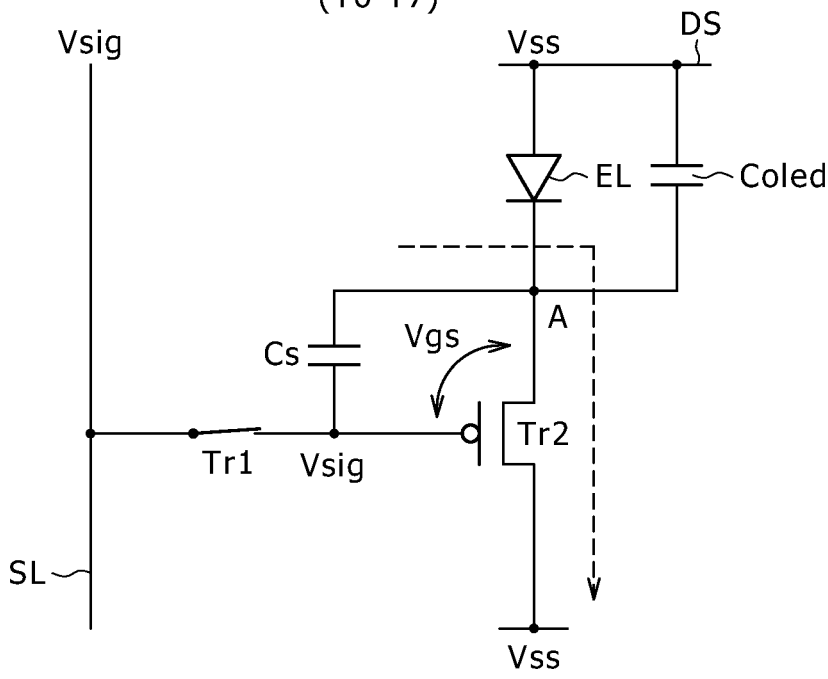
FIG. 6 is a diagrammatic sketch similarly used to describe the operation thereof.

FIG. 6 illustrates the operating status of the pixel circuit during a signal writing and mobility correction period T6 to T7. Here, the signal line SL changes from Vosf to Vsig first. Then, the sampling transistor Tr1 turns on again. This causes Vsig to be written to the gate of the drive transistor Tr2. As a result, the potential of the node A is determined by the capacitance coupling ratio between the holding capacitance Cs and an equivalent capacitor Coled of the light-emitting diode. Therefore, the voltage Vgs of the drive transistor Tr2 is given by following formula 1.

$$V_{gs} = |V_{th}| + \frac{Coled}{Cs + Coled}(V_{ofs} - V_{sig}) \quad \text{Formula 1}$$

At this time, the drain current Ids flows via the drive transistor Tr2. Therefore, the potential of the node A drops by ΔV, thus correcting the mobility while at the same time writing the signal potential Vsig. In order to provide the appropriate mobility correction amount ΔV, the signal writing and mobility correction period T6 to T7 is set to a significantly short duration or several μs. The current Ids after the mobility correction is given by formula 2. In formula 2, t is the mobility correction time, and C the sum of the holding capacitor Cs and equivalent capacitor Coled.

$$I_{ds} = k\mu\left(\frac{V'_{gs}}{1 + V'_{gs}\frac{k\mu}{C}t}\right)^2 \quad \text{Formula 2}$$

$$\left(\text{where } V'_{gs} = \frac{Coled}{Cs + Coled}(V_{ofs} - V_{sig})\right)$$

Figure 7:
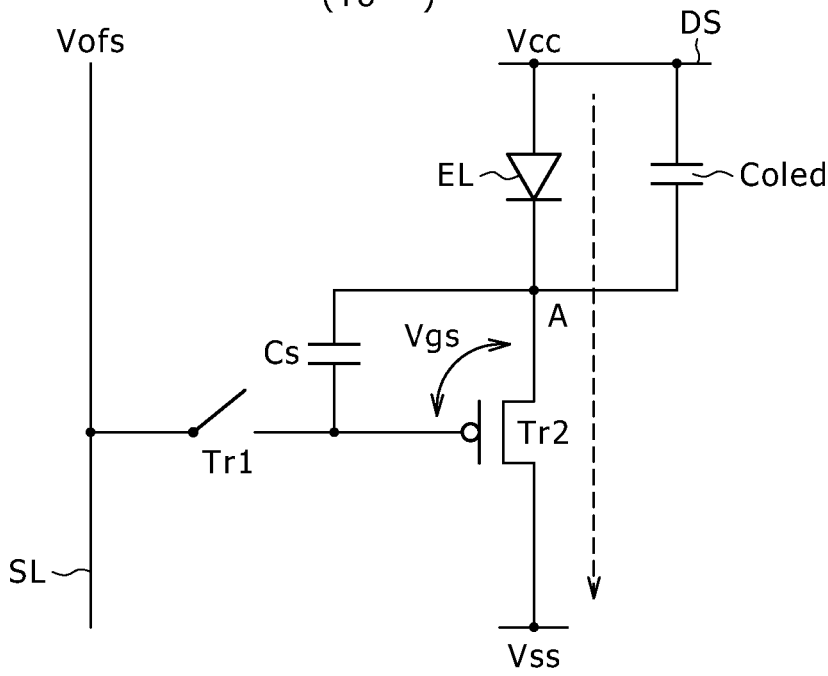
FIG. 7 is a diagrammatic sketch similarly used to describe the operation thereof.

FIG. 7 is a diagrammatic sketch illustrating the operating status of the pixel circuit 2 during the light emission period. During this period, the power line changes to the high potential Vcc after the sampling transistor Tr1 turns off, turning on the light-emitting element EL. As a result, a steady-state current, determined by Vgs, flows through the same element EL, causing the same element EL to emit light. At this time, the variations of the threshold voltage Vth and mobility μ of the drive transistor Tr2 have already been corrected, thus delivering highly uniform image quality free from uneven brightness. During the light emission period, the source potential of the drive transistor Tr2 increases to the potential determined by the operating point. The gate potential thereof will also increase with increase in the source potential. The voltage Vgs of the drive transistor Tr2 remains constant even in the event of a change in the operating point as a result of the change in the characteristics of the light-emitting element EL. As a result, the light emission brightness remains unchanged. The aforementioned operations make it possible to configure a variation correction circuit using P-channel transistors with minimal characteristic variations between elements and an excellent Early effect suppression characteristic. This provides improved image quality and higher definition of the display panel.

Figure 8:
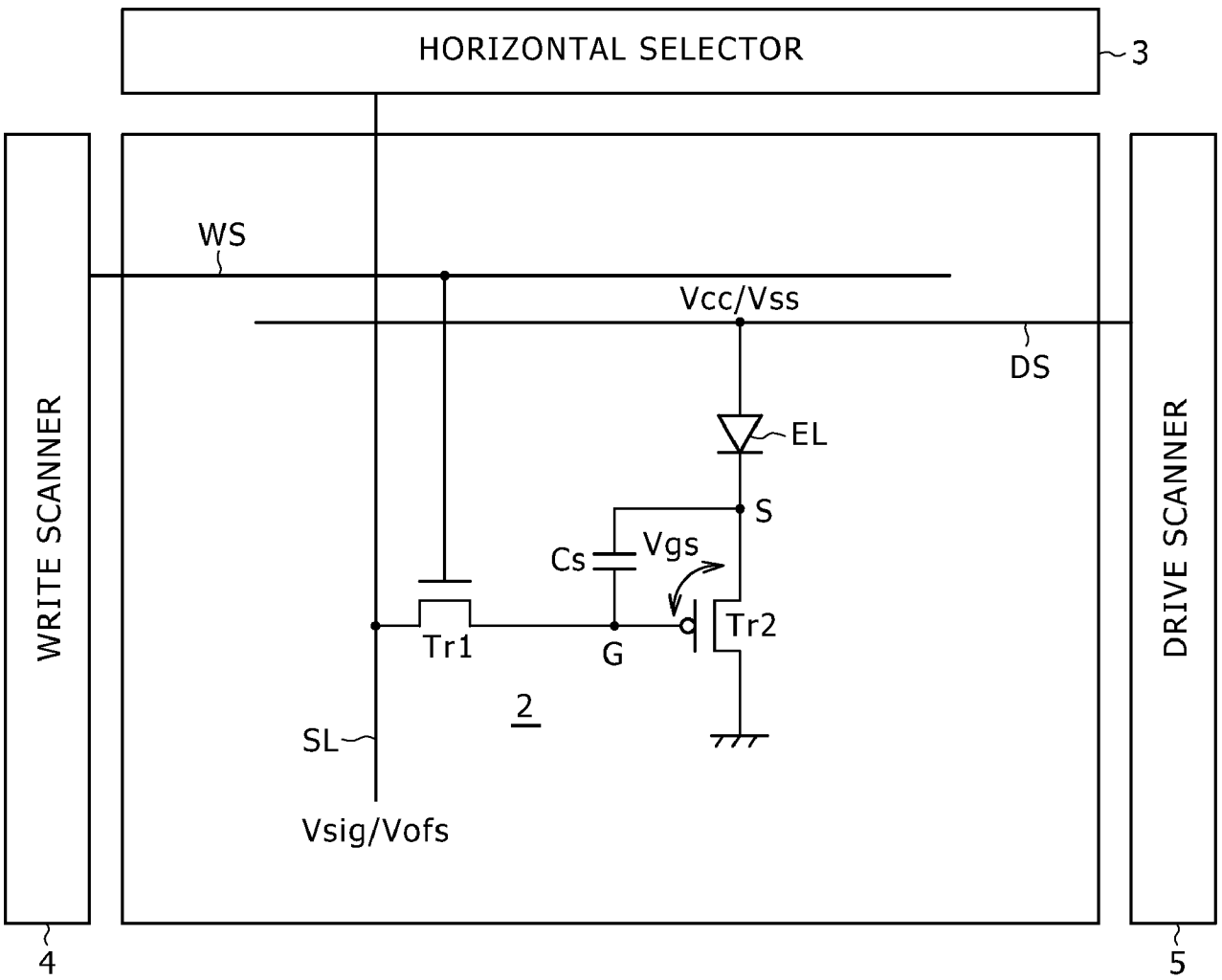
FIG. 8 is a circuit diagram illustrating another embodiment of the display device according to the present embodiment.

FIG. 8 is a circuit diagram illustrating another embodiment of the display device according to the present invention. To facilitate the understanding thereof, like reference numerals designate like components as those of the previous embodiment shown in FIG. 2. The present embodiment differs from the embodiment shown in FIG. 2 in that the sampling transistor Tr1 is an N-channel transistor rather than a P-channel transistor. The sampling transistor Tr1 is basically a switching transistor and does not cause any inconvenience in terms of characteristic even when the same transistor Tr1 is an N-channel transistor.

Figure 9:
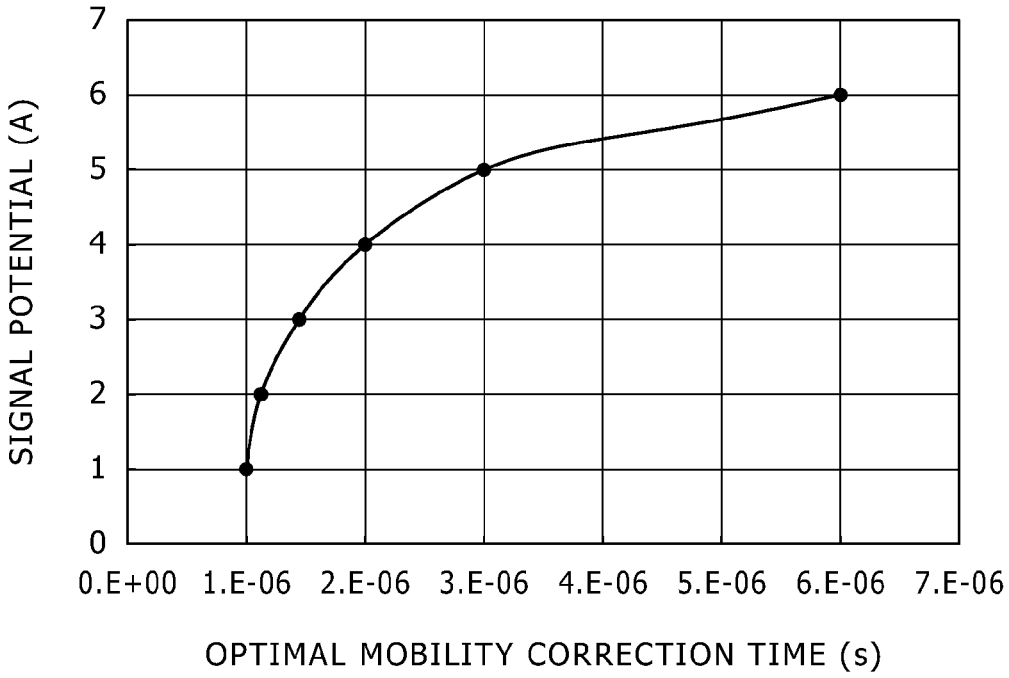
FIG. 9 is a graph used to describe a developed embodiment of the display device according to the present embodiment.

A description will be given next of a developed embodiment of the display device according to the present invention. This developed embodiment can automatically and variably adjust the mobility correction time t to match the signal potential level. FIG. 9 is a graph illustrating the relationship between the signal potential and optimal mobility correction time. The graph shows the signal potential along the vertical axis and the optimal mobility correction time along the horizontal axis. If the drive transistor Tr2 is a P-channel transistor as in the present embodiment, the lower the signal potential, the larger the drive current, and the higher the light emission brightness. Therefore, as the signal potential rises, the light emission brightness changes from white through shades of gray to black. As is clear from the graph, when the signal potential is at white level, the optimal mobility correction time tends to be relatively short. In contrast, when the signal potential is at black level, the optimal mobility correction time tends to be relatively long. To provide improved screen uniformity and image quality, the mobility correction time should preferably be adaptively controlled according to the signal potential.

Figure 10:
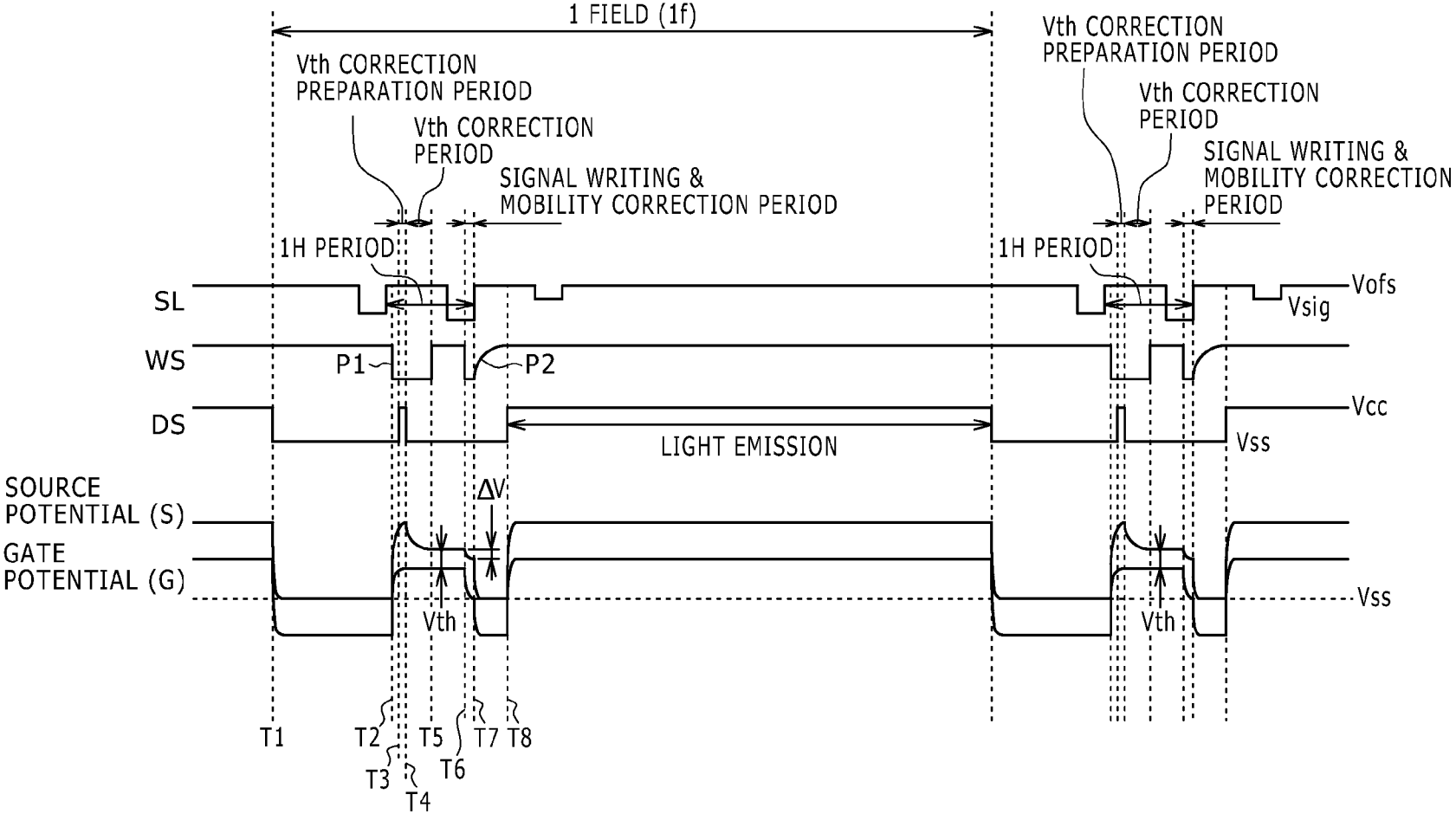
FIG. 10 is a timing diagram used to describe the developed embodiment of the display device according to the present embodiment.

FIG. 10 is a timing diagram used to describe the operation of the developed embodiment of the display device according to the present invention. To facilitate the understanding thereof, like reference numerals designate like components as those of the timing diagram of the previous embodiment shown in FIG. 3. The developed embodiment differs from the embodiment shown in FIG. 3 in that the negative pulse of the control signal WS has a slowly, rising leading edge. The negative pulse of the control signal WS determines the length of the signal writing and mobility correction period. This makes it possible to automatically and changeably adjust the mobility correction time t according to the signal potential Vsig.

Figure 11:
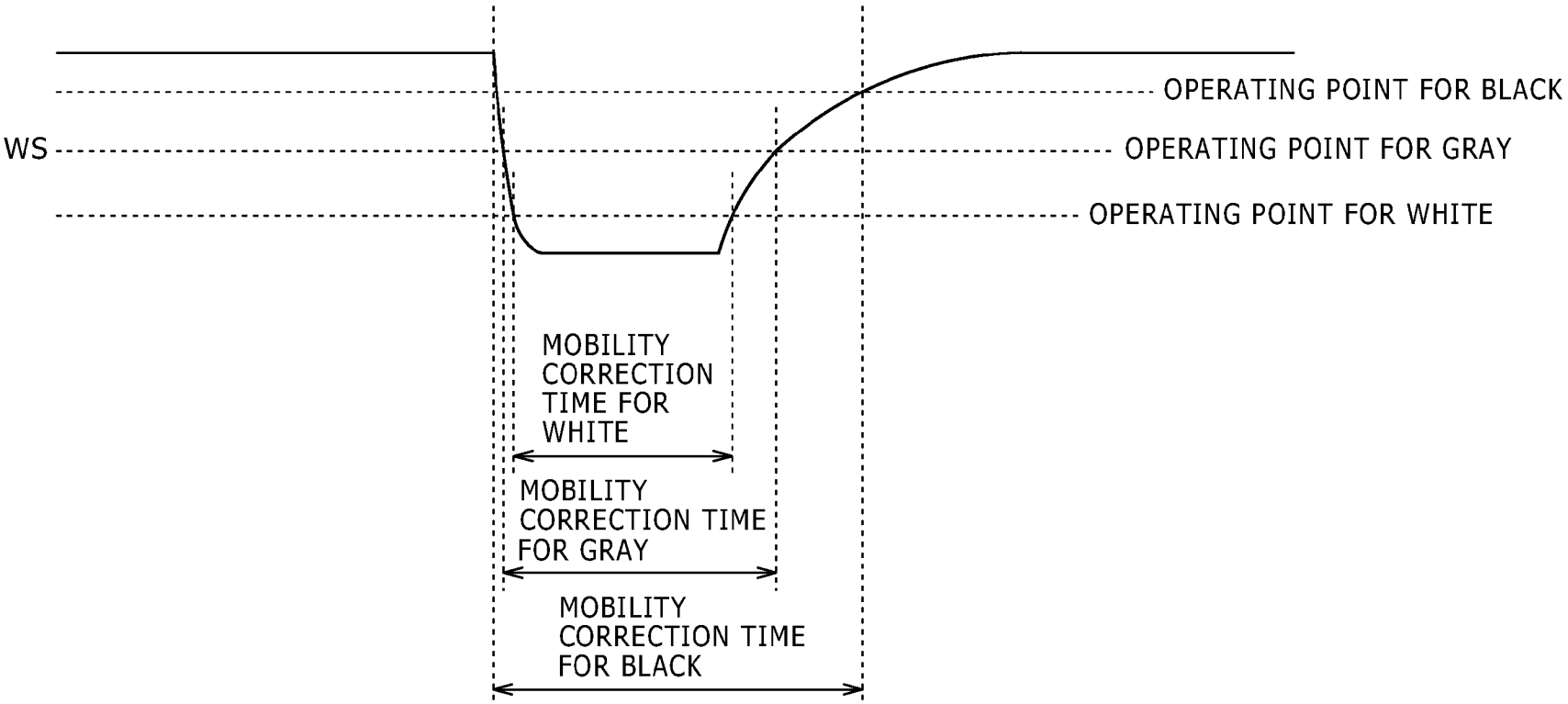
FIG. 11 is a waveform diagram similarly used to describe the developed embodiment.

FIG. 11 is a waveform diagram illustrating an enlarged view of the negative pulse of the control signal WS appearing between times T6 and T7 shown in FIG. 10. The sampling transistor Tr1 is a P-channel transistor. The same transistor Tr1 turns on as the control signal WS changes from high to low level. In contrast, the same transistor Tr1 turns off as the control signal WS changes from low to high level. The same signal WS has a steeply falling trailing edge from high to low level, turning on the sampling transistor Tr1 immediately. In contrast, the same signal WS has a slowly rising leading edge from low to high level, allowing the sampling transistor Tr1 to turn off at a different timing depending on the operating point. The signal potential Vsig is applied to the source of the sampling transistor Tr1. The control signal WS is applied to the gate thereof. Therefore, the operating point of the sampling transistor Tr1 varies depending on the signal potential Vsig. The operating point is low for white with the low signal potential Vsig. Therefore, the sampling transistor Tr1 turns off relatively early. As a result, the mobility correction time for white is relatively short. In contrast, the operating point is close to high level when the signal potential is at black level. Therefore, the sampling transistor Tr1 turns off later. As a result, the mobility correction time for black is long. For shades of gray between white and black, the mobility correction time is intermediate in length between those for white and black. As described above, the present embodiment can automatically adjust the mobility correction time to the optimal level according to the level of the signal potential Vsig. In order to achieve such a mobility correction, the sampling transistor Tr1 should preferably be a P-channel transistor rather than an N-channel transistor.

Figure 12:
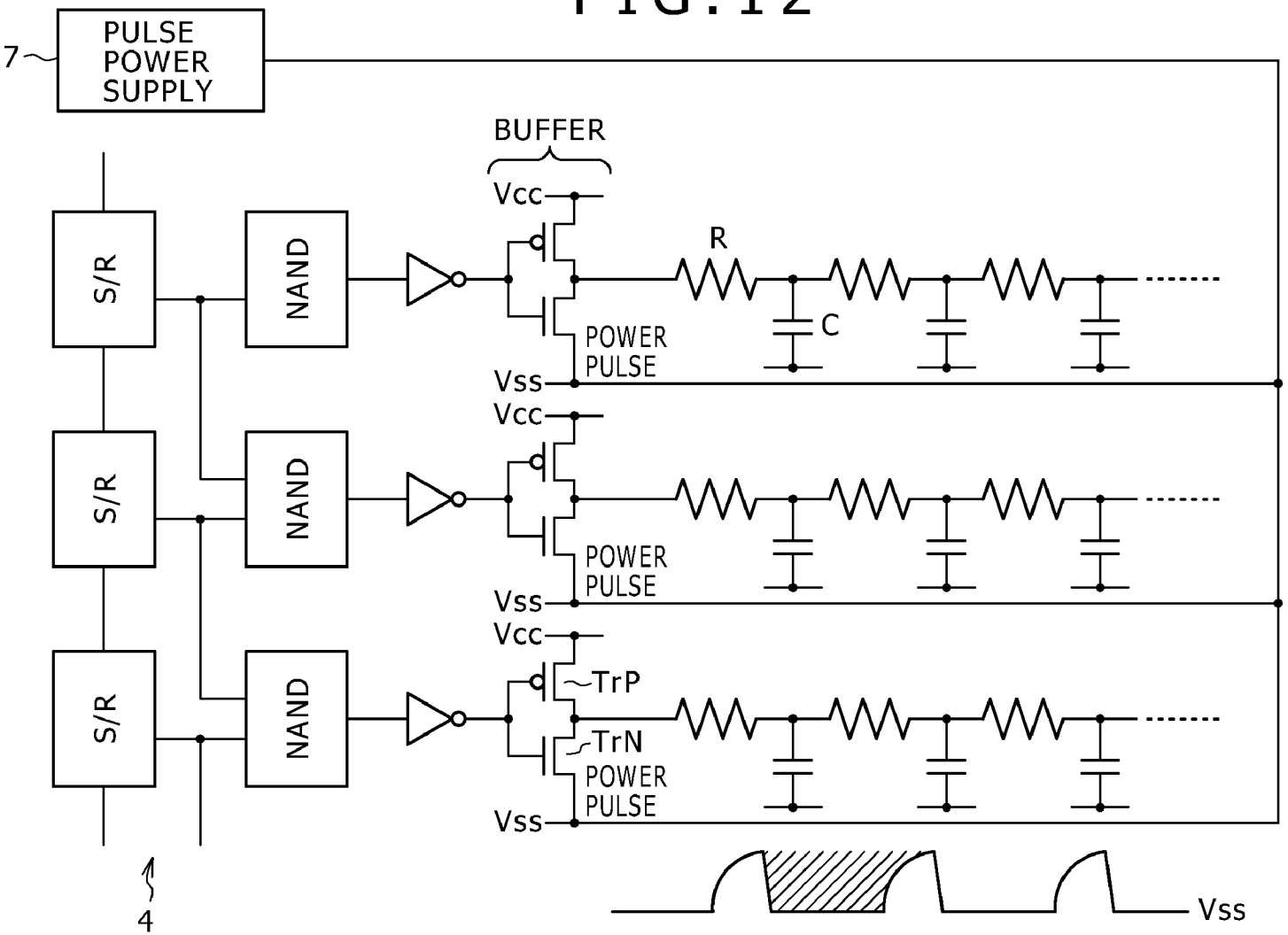
FIG. 12 is a circuit diagram illustrating the configuration of a write scanner similarly used to describe the developed embodiment.

FIG. 12 is a circuit diagram illustrating an example of the write scanner used for the present developed embodiment. FIG. 12 diagrammatically illustrates three stages of the output section of the write scanner 4 and three rows (three lines) of the pixel array section 1 which are connected to the three stages. The write scanner 4 includes a shift register S/R which operates in response to an externally supplied clock pulse. The shift register S/R sequentially shifts an externally supplied start signal to sequentially output a signal from each stage. The same register S/R has a NAND element connected to each of its stages to NAND the sequential signals from each pair of the adjacent stages so as to produce a rectangular waveform on which the control signal is based. Each of these rectangular waveforms is fed to an output buffer via an inverter. The output buffer operates in response to an input signal from the shift register S/R to supply an eventual control signal to the associated scan line WS of the pixel array section 1.

Each of the output buffers includes a pair of switching elements connected in series between the power potential Vcc and ground potential Vss. One of the switching elements is a P-channel transistor TrP, and the other an N-channel transistor TrN. It should be noted that each line of the pixel array section 1 connected to one of the output buffers is denoted by resistive components R and capacitive components C in the same way as in an equivalent circuit. Here, a pulse power supply 7 is connected to the ground line Vss of the output buffer for each stage. The pulse power supply supplies a power pulse to the ground line Vss at intervals of 1H. The output buffer extracts the power pulse in response to the input pulse from the NAND element to supply this pulse to the scan line WS as the output pulse. As illustrated at the bottom of FIG. 12, the negative power pulse shown as hatched has a steeply falling trailing edge and slowly rising trailing edge. This slowly rising portion of the trailing edge is extracted in an "as-is" form for use as the control signal WS. The same signal WS is used for automatic control of the mobility correction time.

Figure 13:
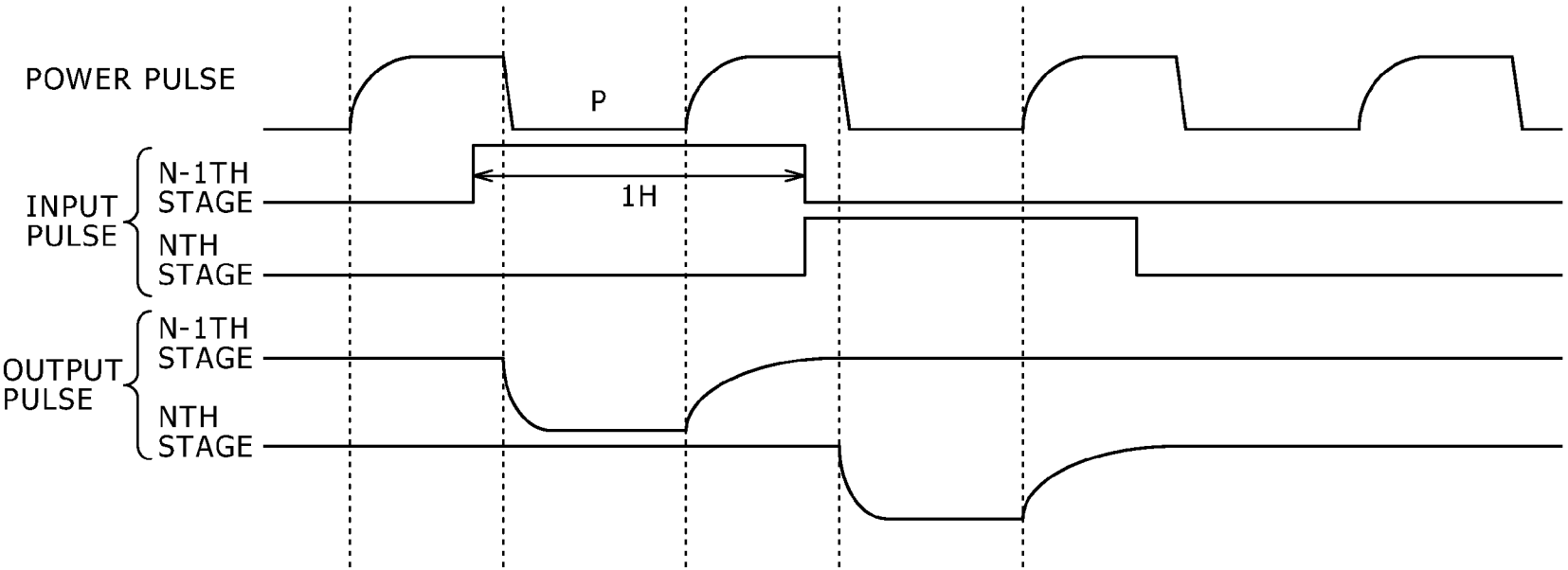
FIG. 13 is a timing diagram used to describe the operation of the write scanner shown in FIG. 12.

FIG. 13 is a timing diagram used to describe the operation of the write scanner shown in FIG. 12. As illustrated in FIG. 13, the pulse power supply 7 supplies a power pulse string containing a negative pulse P to the ground line of the output buffer. The timing diagram in FIG. 13 also illustrates the input pulses fed to the output buffer and the output pulses in a chronologically consistent manner with the power pulse. FIG. 13 shows the input pulses fed to the output buffers at the N−1th and Nth stages and their output pulses. Each of the input pulses is a rectangular pulse which is shifted by 1H from one stage to the next. When the input pulse is fed to the output buffer at the N−1th stage, the inverter turns on to extract the pulse P in an "as-is" form from the ground line. The extracted pulse serves as the output pulse from the output buffer at the N−1th stage and is fed in an "as-is" form to the N−1th scan line WS. In the same manner, when the input pulse is fed to the output buffer at the Nth stage, the output pulse is output from the output buffer at the Nth stage to the associated scan line WS.

Figure 14:
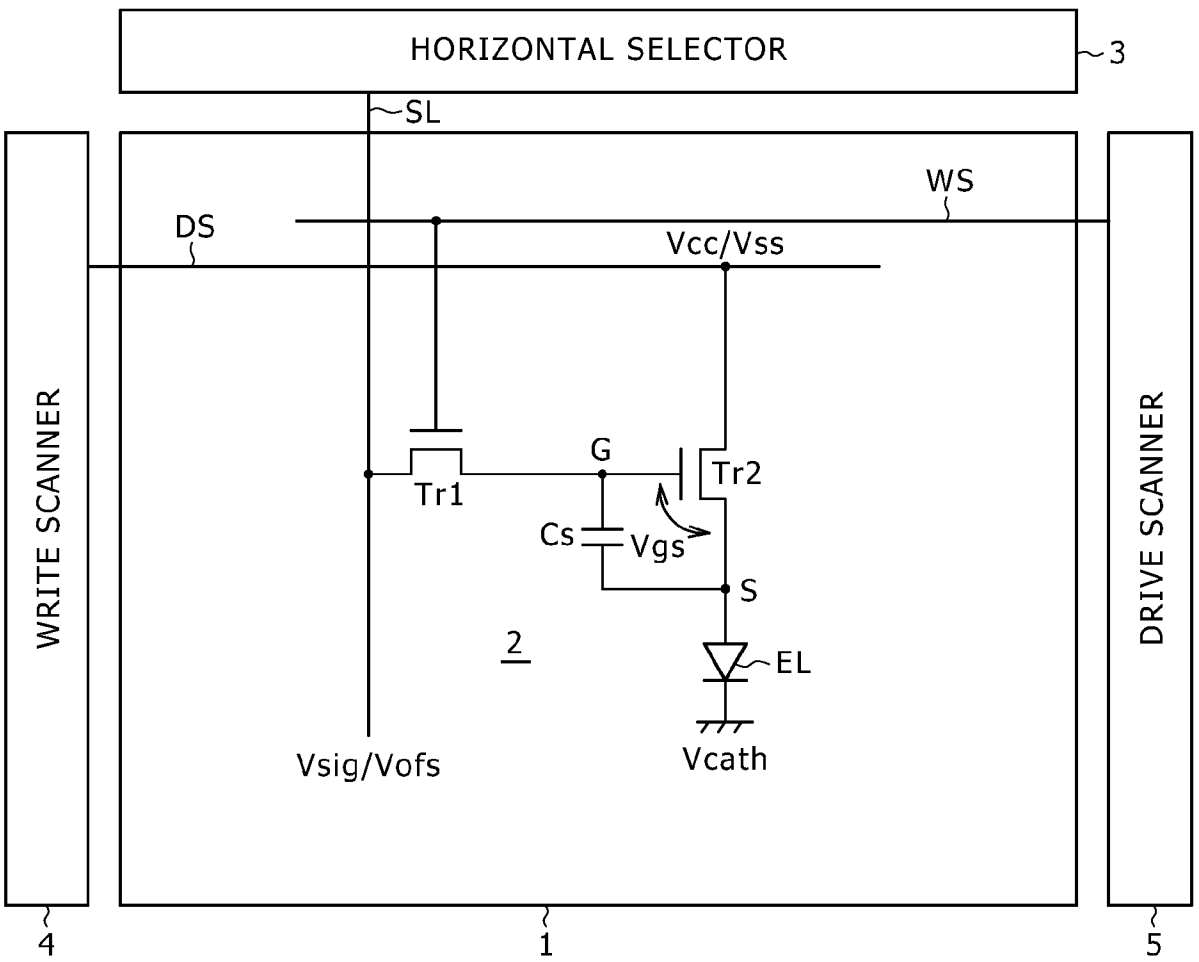
FIG. 14 is a circuit diagram illustrating the configuration of a display device according to a reference example.

A description will be given below, for reference purposes, of an example of the pixel circuit using an N-channel drive transistor rather than a P-channel one. FIG. 14 is a block diagram illustrating the configuration of the display device according to the reference example. As illustrated in FIG. 14, the pixel 2 includes the light-emitting element EL typified by an organic EL element, sampling transistor Tr1, drive transistor Tr2 and holding capacitor Cs. This display device differs from the one according to the present embodiment in that the drive transistor Tr2 is an N-channel transistor rather than a P-channel transistor. The N-channel drive transistor has a larger variation in the threshold voltage Vth and mobility μ than the P-channel one. In addition, the Early effect is more conspicuous in the former. As a result, the N-channel drive transistor is inferior to the P-channel one in terms of these characteristics for use in the pixel circuits of the display device.

The sampling transistor Tr1 has its control terminal (gate) connected to the associated scan line WS, one of the pair of current terminals (source and drain) connected to the associated signal line SL and the other thereof connected to the control terminal (gate G) of the drive transistor Tr2. The drive transistor Tr2 has one of the pair of current terminals (source and drain) connected to the light-emitting element EL and the other thereof connected to the associated power line DS. In the present reference example, the drive transistor Tr2 is an N-channel transistor and has its drain connected to the power line DS and its source S connected to the anode of the light-emitting element EL as the output node. The cathode of the light-emitting element EL is connected to a predetermined cathode potential Vcath. The holding capacitor Cs is connected between the source S, one of the current terminals, and the gate, the control terminal, of the drive transistor Tr2.

In the configuration described above, the sampling transistor Tr1 conducts in response to the control signal from the scan line WS, sampling the signal potential from the signal line SL and holding the sampled potential in the holding capacitor Cs. The drive transistor Tr2 is supplied with a current from the power line DS which is at the first potential (high potential Vcc), passing the drive current through the light-emitting element EL according to the level of the signal held in the holding capacitor Cs. In order to bring the sampling transistor Tr1 into conduction during a period of time in which the signal line SL is at the signal potential, the write scanner 4 outputs the control signal of predetermined pulse width to the control line WS, thus holding the signal potential in the holding capacitor Cs and correcting the signal potential so as to correct the mobility μ at the same time. Thereafter, the drive transistor Tr2 supplies the drive current commensurate with the signal potential Vsig written to the holding capacitor Cs, thus initiating the light emission.

The present pixel circuit 2 has a threshold voltage correction function in addition to the mobility correction function described above. That is, the drive scanner 5 changes the power line DS from the first potential (high potential Vcc) to the second potential (low potential Vss) at the first timing before the sampling transistor Tr1 samples the signal potential Vsig. On the other hand, the write scanner 4 brings the sampling transistor Tr1 into conduction at the second timing similarly before the same transistor Tr1 samples the signal potential Vsig. This applies the reference potential Vofs to the gate G of the drive transistor Tr2 from the signal line SL and sets the source S of the same transistor Tr2 to the second potential (Vss). The drive scanner 5 changes the power line DS from the second potential Vss to the first potential Vcc at the third timing following the second timing, holding the voltage corresponding to the threshold voltage Vth of the drive transistor in the holding capacitor Cs. This threshold voltage correction function can cancel out the impact of the variation in the threshold voltage Vth of the drive transistor Tr2 between different pixels.

In addition, the present pixel circuit 2 has a bootstrapping function. That is, the write scanner 4 remove the control signal from the scan line WS when the signal potential Vsig is held in the holding capacitor Cs, bringing the sampling transistor Tr1 out of conduction and electrically disconnecting the gate G of the drive transistor Tr2 from the signal line SL. This causes the potential of the gate G of the drive transistor Tr2 to change with change in potential of the source S thereof, thus maintaining the voltage Vgs between the gate G and source S constant.

Figure 15:
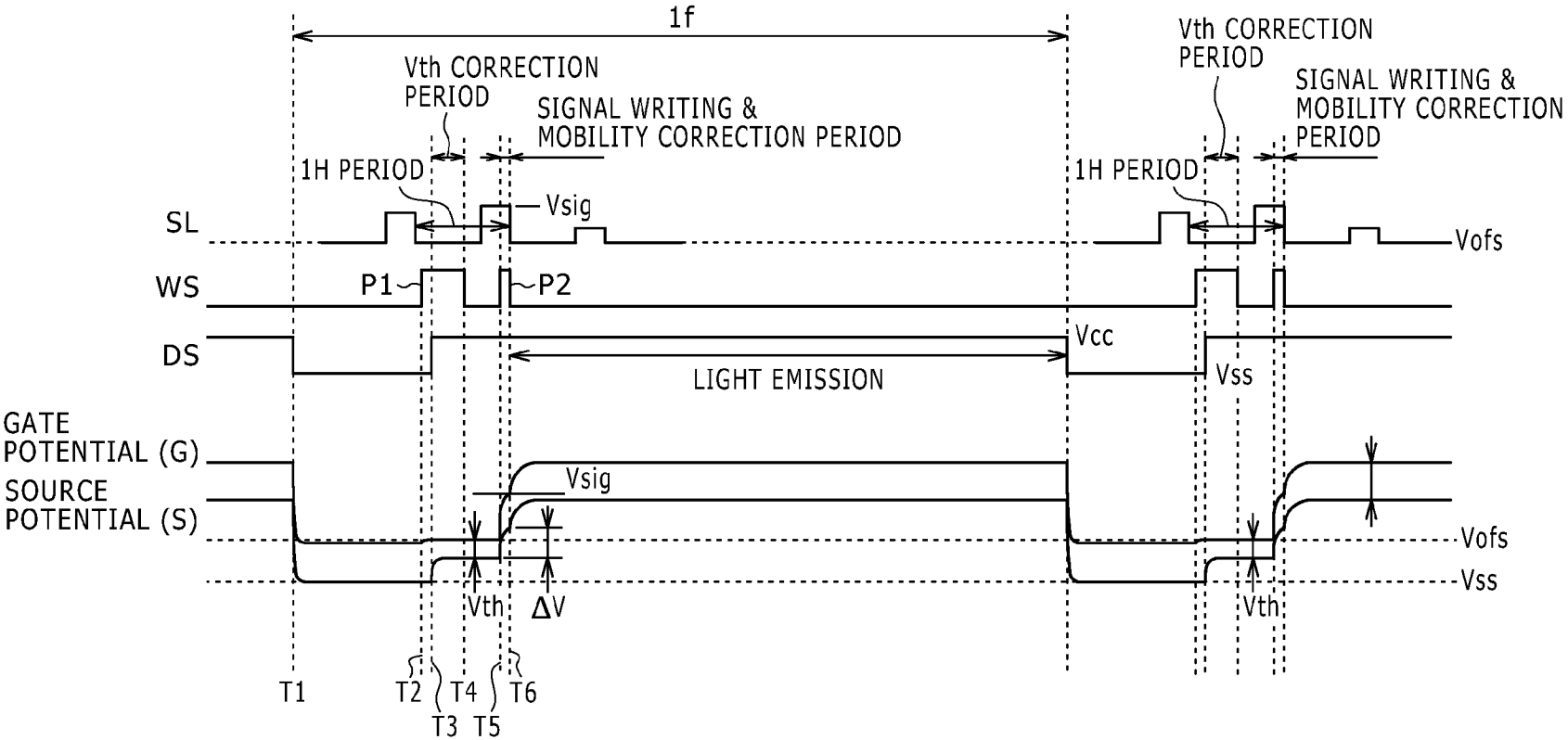
FIG. 15 is a timing diagram used to describe the operation of the display device according to the reference example.

FIG. 15 is a timing diagram used to describe the operation of the pixel circuit 2 shown in FIG. 14. The timing diagram illustrates the changes in potential of the scan line WS, power line DS and signal line SL along a common time axis. The timing diagram also illustrates the changes in potential of the gate G and source S of the drive transistor in parallel with the above changes.

The control signal pulse is applied to the scan line WS to turn on the sampling transistor Tr1. This control signal pulse is applied to the scan line WS at intervals of one field (1f) in step with the linear sequential scan of the pixel array section. This pulse contains two pulses during one horizontal scan period (1H). The first pulse is referred to as the first pulse P1, and the second pulse the second pulse P2. The power line DS similarly switches between the high and low potentials Vcc and Vss over a period of one field. The signal line SL is supplied with the video signal which alternates between the signal potential Vsig and reference potential Vofs within one horizontal scan period (1H).

As illustrated in the timing diagram of FIG. 15, the light emission period for the previous field is followed first by the non-light emission period for the current field and next by the light emission period for the same field. During the non-light emission period, preparation, threshold voltage correction, signal writing, mobility correction and other operations are performed.

During the light emission period for the previous field, the power line DS is at the high potential Vcc. As a result, the drive transistor Tr2 supplies the drive current Ids to the light-emitting element EL. The drive current Ids flows from the power line DS at the high potential Vcc into the cathode line via the drive transistor Tr2 and light-emitting element EL.

Next, at time T1 when the non-light emission period begins for the current field, the power line DS changes from the high potential Vcc to the low potential Vss. This causes the power line DS to discharge to Vss. Further, the source S of the drive transistor Tr2 declines in potential to Vss. As a result, the anode potential of the light-emitting element EL (i.e., source potential of the drive transistor Tr2) is reverse-biased, causing the same element EL to go out because the drive current stops flowing therethrough. At this time, the gate G of the drive transistor declines in potential with the decline in potential of the source S thereof.

Next, at time T2, the scan line WS changes from low to high level, bringing the sampling transistor Tr1 into conduction. At this time, the signal line SL is at the reference potential Vofs. As a result, the potential of the gate G of the drive transistor Tr2 is brought to the level of the reference potential Vofs of the signal line SL via the sampling transistor Tr1 which is conducting. At this time, the potential of the source S of the drive transistor Tr2 is at Vss which is sufficiently lower than Vofs. Thus, the voltage Vgs between the gate G and source S of the drive transistor Tr2 is initialized to be greater than the threshold voltage Vth of the drive transistor Tr2. A period T1 to T3 from time T1 to T3 is the preparation period adapted to set the voltage Vgs between the gate G and source S of the drive transistor Tr2 greater than Vth.

At time T3 thereafter, the power line DS changes from the low potential Vss to the high potential Vcc, causing the potential of the source S of the drive transistor Tr2 to start rising. The current cuts off after a while when the voltage Vgs between the gate G and source S of the drive transistor Tr2 is brought equal to the threshold voltage Vth. Thus, the voltage corresponding to the threshold voltage of the drive transistor Tr2 is written to the holding capacitor Cs. This is the threshold voltage correction operation. At this time, in order to ensure that all of the current flows into the holding capacitor Cs and none into the light-emitting element EL, the cathode potential Vcath is set so as to bring the same element EL into cutoff.

At time T4, the scan line WS changes from high to low level. In other words, the first pulse P1 is removed from the scan line WS, turning off the sampling transistor. As is clear from the above description, the first pulse P1 is applied to the gate of the sampling transistor Tr1 to perform the threshold voltage correction operation.

Thereafter, the signal line SL changes from the reference potential Vofs to the signal potential Vsig. Next, at time T5, the scan line WS rises from low to high level. In other words, the second pulse P2 is applied to the gate of the sampling transistor. This turns on the sampling transistor Tr1 again, causing the same transistor Tr1 to sample the signal potential Vsig from the signal line SL. As a result, the potential of the gate G of the drive transistor Tr2 is brought equal to the signal potential Vsig. Here, the light-emitting element EL is in a cutoff state (high impedance state) at first. Therefore, all of the current flowing from the drain to source of the drive transistor Tr2 flows into the holding capacitor Cs and equivalent capacitor of the light-emitting element EL, thus charging these capacitors. Thereafter, the potential of the source S of the drive transistor Tr2 increases by ΔV by time T6 when the sampling transistor Tr1 turns off. Thus, the video signal potential Vsig is written to the holding capacitor Cs in such a manner that the same potential Vsig is added to Vth. At the same time, the mobility correction voltage ΔV is subtracted from the voltage held in the holding capacitor Cs. Therefore, a period T5-T6 from time T5 to T6 is the signal writing and mobility correction period. In other words, the application of the second pulse P2 to the scan line WS initiates the signal writing and mobility correction operation. The signal writing and mobility correction period T5 to T6 is equal in length to the width of the second pulse P2. That is, the width of the second pulse P2 determines the length of the mobility correction period.

Thus, the writing of the signal potential Vsig and the adjustment of the correction amount ΔV are performed simultaneously during the signal writing period T5-T6. The higher Vsig, the larger the current Ids supplied by the drive transistor Tr2, and the larger the absolute value of ΔV. As a result, the mobility is corrected according to the light emission brightness level. Assuming the constant Vsig, the larger the mobility μ of the drive transistor Tr2, the larger the absolute value of ΔV. In other words, the larger the mobility μ, the larger the amount of feedback ΔV to the holding capacitor Cs. This eliminates the variation of the mobility μ between different pixels.

Finally at time T6, the scan line changes to low level as mentioned earlier, turning off the sampling transistor Tr1. This electrically disconnects the gate G of the drive transistor. Tr2 from the signal line SL. At the same time, the drain current Ids begins to flow through the light-emitting element EL. As a result, the anode potential of the light-emitting element EL increases according to the drive current Ids. The increase in the anode potential of the light-emitting element EL is none other than the increase in the potential of the source S of the drive transistor Tr2. As the potential of the source S of the drive transistor Tr2 increases, the potential of the gate G thereof will also increase because of the bootstrapping action of the holding capacitor Cs. The increment of the gate potential will be equal to that of the source potential. Hence, the voltage Vgs between the gate G and source S of the drive transistor Tr2 is maintained constant during the light emission period. The Vgs value is equal to the signal potential Vsig corrected for the threshold voltage Vth and mobility μ. The drive transistor Tr2 operates in the saturation region. That is, the same transistor Tr2 supplies the drive current Ids commensurate with the voltage Vgs between the gate G and source S. The Vgs value is equal to the signal potential Vsig corrected for the correction of the threshold voltage Vth and mobility μ.

Figure 16:
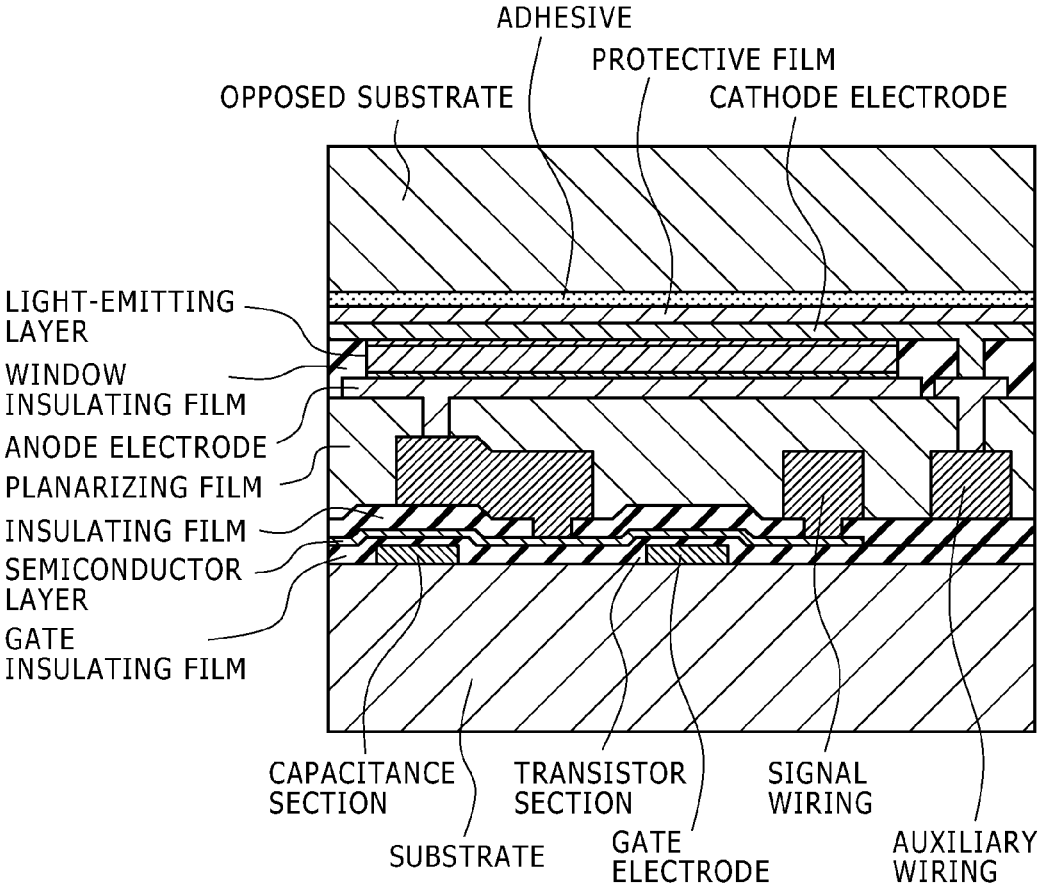
FIG. 16 is a sectional view illustrating the device configuration of the display device according to the present embodiment.

The display device according to the present embodiment has a thin film device structure as illustrated in FIG. 16. The diagram in FIG. 16 illustrates the diagrammatic sectional view of the pixel formed on an insulating substrate. As illustrated in FIG. 16, the pixel includes a transistor section, capacitance section and light-emitting section. The transistor section includes a plurality of thin film transistors (one TFT shown as an example in FIG. 16). The capacitance section includes, for example, a holding capacitor. The light-emitting section includes, for example, an organic EL element. The transistor and capacitance sections are formed on the substrate by the TFT process, with the light-emitting section including the organic EL element and other components stacked on top thereof. Finally, a transparent opposed substrate is attached atop with adhesive for use as a flat panel.

Figure 17:
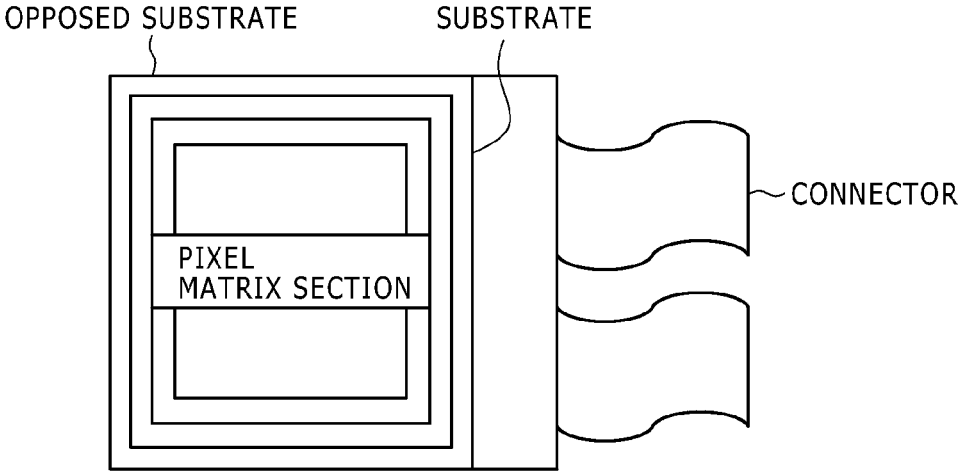
FIG. 17 is a plan view illustrating the modular configuration of the display device according to the present embodiment.

The display device according to the present embodiment includes a flat display device in a modular form as illustrated in FIG. 17. For example, a pixel array section is provided on an insulating substrate 11. The pixel array section has pixels integrated in a matrix form. Each of the pixels includes an organic EL element, thin film transistors, thin film capacitors and other components. Adhesive is applied around the pixel array section (pixel matrix section), after which an opposed substrate made of glass or other material is attached for use as a display module. This transparent opposed substrate may have a color filter, protective film, light-shielding film and so on as necessary. An FPC (flexible printed circuit), adapted to allow exchange of signals or other information between external equipment and the pixel array section, may be provided as a connector on the display module.

The aforementioned display device according to the present embodiment is applicable as a display of a wide range of electronic equipment including a digital camera, laptop personal computer, mobile phone and video camcorder. These pieces of equipment are designed to display an image or video of a video signal fed to or generated inside the electronic equipment. Examples of electronic equipment, to which such a display device is applied, will be given below.

Figure 18:
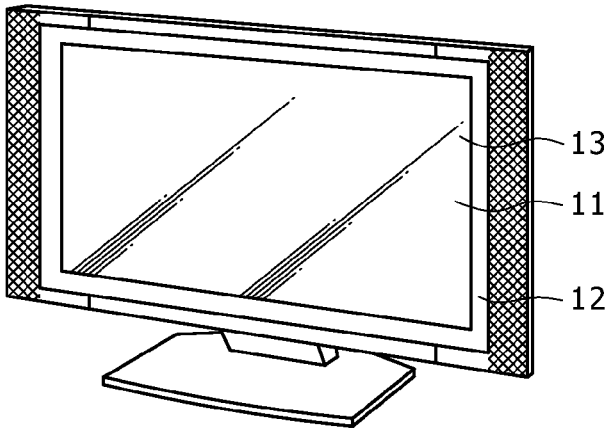
FIG. 18 is a perspective view illustrating a television set having the display device according to the present embodiment.

FIG. 18 illustrates a television set to which the present embodiment is applied. The television set includes a video display screen 11 made up, for example, of a front panel 12, filter glass 13 and other parts. The television set is manufactured by using the display device according to the present embodiment as the video display screen 11.

Figure 19:
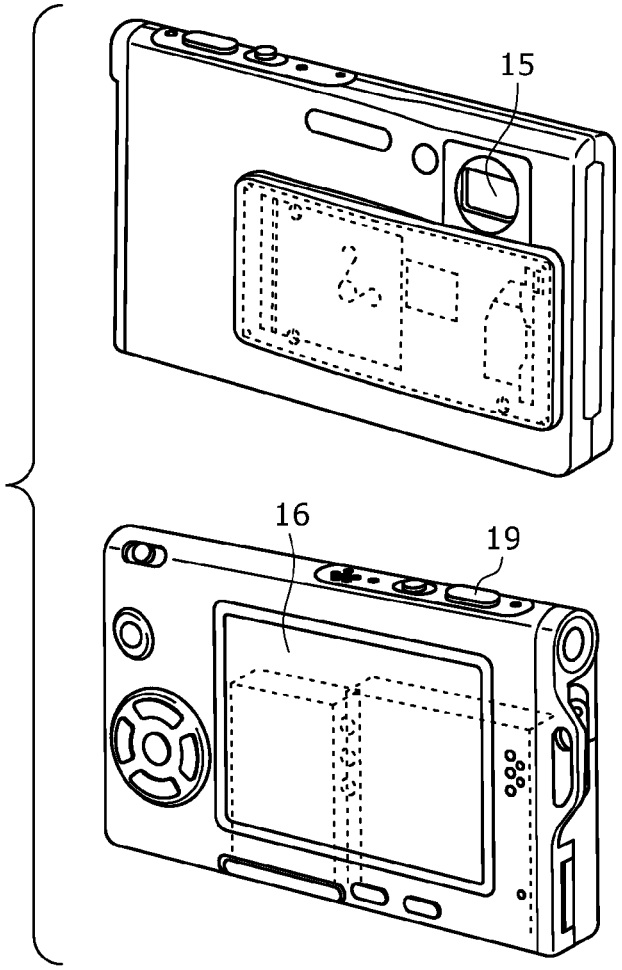
FIG. 19 is a perspective view illustrating a digital camera having the display device according to the present embodiment.

FIG. 19 illustrates a digital camera to which the present embodiment is applied. The figure on the top is a front view, and the figure on the bottom a rear view. This digital camera includes an imaging lens, flash-emitting section 15, display section 16, control switch, menu switch, shutter 19 and other parts. The digital camera is manufactured by using the display device according to the present embodiment as the display section 16.

Figure 20:
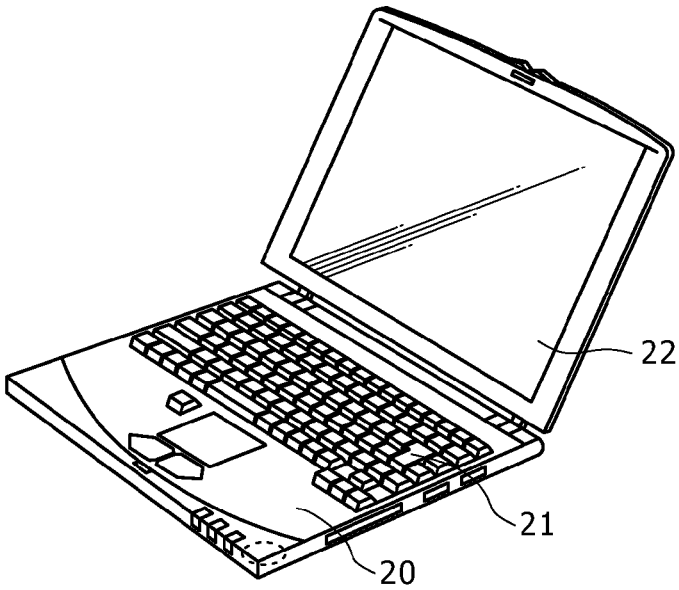
FIG. 20 is a perspective view illustrating a laptop personal computer having the display device according to the present embodiment.

FIG. 20 illustrates a laptop personal computer to which the present embodiment is applied. The laptop personal computer includes, in a main body 20, a keyboard 21 adapted to be manipulated for entry of text or other information, and, in the main body cover, a display section 22 adapted to display an image. The laptop personal computer is manufactured by using the display device according to the present embodiment as the display section 22.

Figure 21:
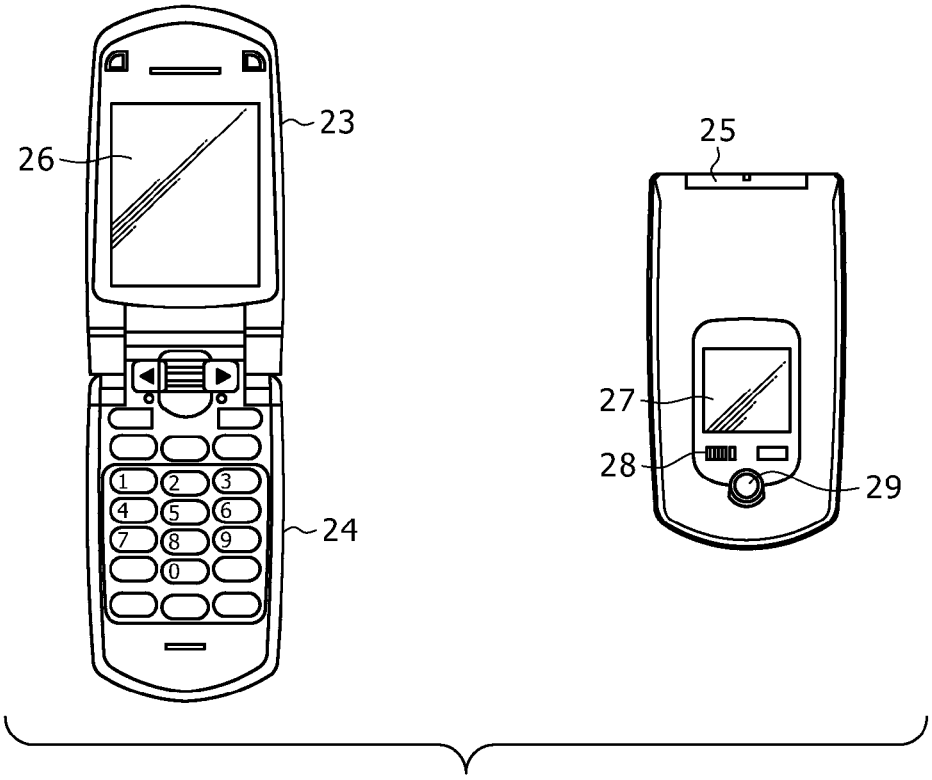
FIG. 21 is a perspective view illustrating a personal digital assistance having the display device according to the present embodiment.

FIG. 21 illustrates a personal digital assistant to which the present embodiment is applied. The figure at left illustrates the personal digital assistant in an open position. The figure at right illustrates the personal digital assistant in a closed position. The personal digital assistant includes an upper enclosure 23, lower enclosure 24, connecting section (hinge section in this example) 25, display 26, subdisplay 27, picture light 28, camera 29 and other parts. The personal digital assistant is manufactured by using the display device according to the present embodiment as the display 26 and subdisplay 27.

Figure 22:
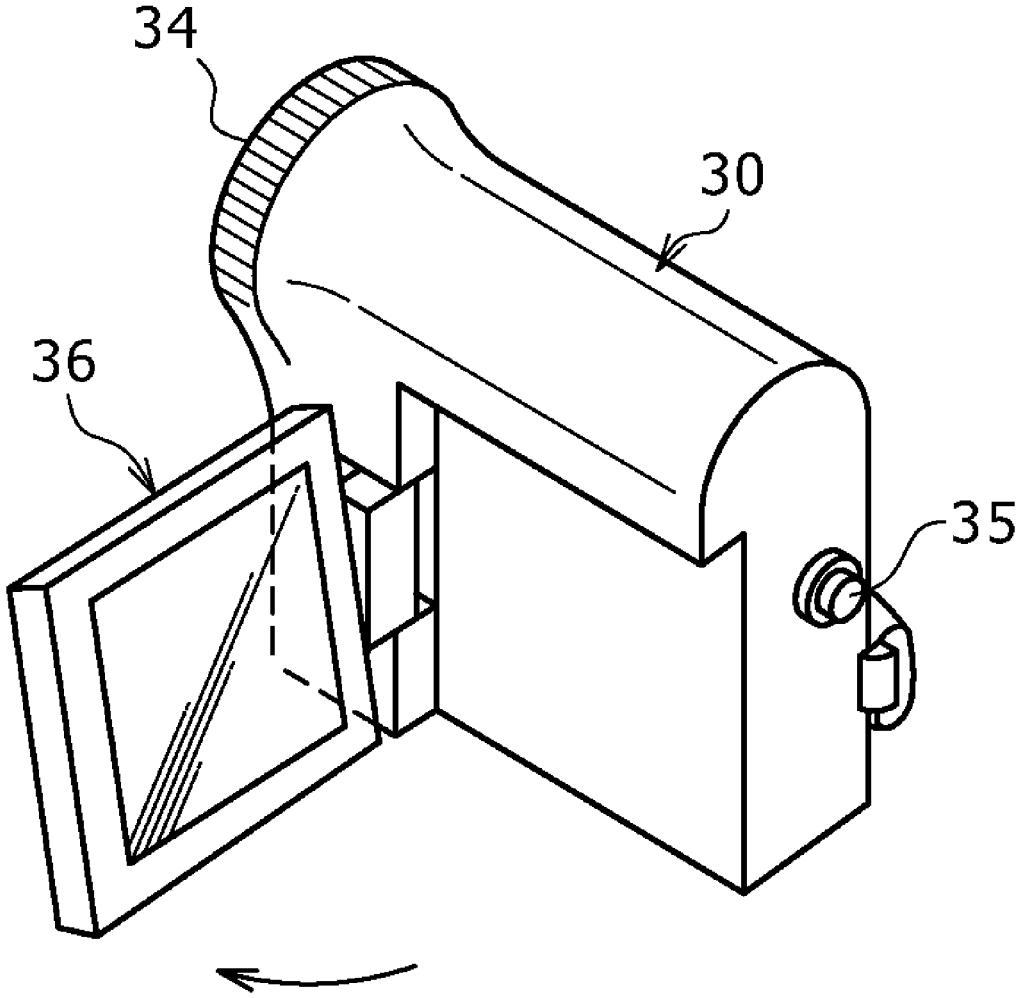
FIG. 22 is a perspective view illustrating a video camcorder having the display device according to the present embodiment.

FIG. 22 illustrates a video camcorder to which the present embodiment is applied. The video camcorder includes a main body section 30, lens 34 provided on the front-facing side surface to capture the image of the subject, imaging start/stop switch 35, monitor 36 and other parts. The video camcorder is manufactured by using the display device according to the present embodiment as the monitor 36.

It should be understood by those skilled in the art that various modifications, combinations, sub-combinations and alterations may occur depending on design requirements and other factors insofar as they are within the scope of the appended claims or the equivalents thereof.

What is claimed is:

1. A display device comprising:

a pixel array section; and a drive section configured to drive the pixel array section, the pixel array section including scan lines, signal lines, and pixels, the drive section including a main scanner configured to supply a control signal to each of the scan lines, and a signal selector configured to supply a signal potential serving as a video signal to the signal lines, wherein each of the pixels includes a light-emitting element, a sampling transistor, a drive transistor and a holding capacitor, the drive transistor and the light-emitting element being connected between a first voltage electrode and a second voltage electrode, the sampling transistor having a gate connected to a scan line, wherein during a period of time in which the signal line is supplied the signal potential, the main scanner supplies the control signal to the scan line to bring the sampling transistor into conduction so that the signal potential from the signal line is sampled and held in the holding capacitor, and the drive transistor passing a drive current through the light-emitting element according to the held signal potential, wherein the control signal has a rising edge and a falling edge, and a time constant of the rising edge is longer than a time constant of the falling edge, such that the rising edge of the control signal provides a first correction period when the signal potential is at a white level, a second correction period when the signal potential is at a gray level, and a third correction period when the signal potential is at a black level, wherein a difference between a duration of the third correction period and the second correction period is larger than a difference between a duration of the first correction period and the second correction period.

2. An electronic apparatus comprising the display device of claim 1.

* * * * *